US006721521B2

(12) United States Patent
Kataoka et al.

(10) Patent No.: US 6,721,521 B2
(45) Date of Patent: Apr. 13, 2004

(54) IMAGE FORMING APPARATUS

(75) Inventors: Hiroshi Kataoka, Shiki-gun (JP); Tadasu Taniguchi, Uda-gun (JP); Keizo Fukunaga, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 455 days.

(21) Appl. No.: 09/780,347

(22) Filed: Feb. 12, 2001

(65) Prior Publication Data

US 2001/0019418 A1 Sep. 6, 2001

(30) Foreign Application Priority Data

Mar. 3, 2000 (JP) ..... 2000-059291

(51) Int. Cl.[7] ..... G03G 15/01
(52) U.S. Cl. ..... 399/112; 399/302
(58) Field of Search ..... 399/112, 111, 399/110, 223, 225, 298, 299, 302; 347/138, 152

(56) References Cited

U.S. PATENT DOCUMENTS 5,537,188 A * 7/1996 Haneda ..... 399/112
6,389,260 B1 * 5/2002 Kataoka et al. ..... 399/298

FOREIGN PATENT DOCUMENTS

| | | | |
|---|---|---|---|
| EP | 0 639 801 A1 | * | 2/1995 |
| JP | 5-341617 | | 12/1993 |
| JP | 07-056416 | * | 3/1995 |
| JP | 09-096998 | * | 4/1997 |
| JP | 09-160471 | * | 6/1997 |

* cited by examiner

*Primary Examiner*—Sophia S. Chen
(74) *Attorney, Agent, or Firm*—Birch, Stewart, Kolasch & Birch, LLP

(57) ABSTRACT

An image forming apparatus includes the first image forming section for forming color images, and the second image forming section for forming monochrome images, wherein the first image forming section is slidable through an opening formed on the front face of the main body, while the second image forming section is slidable through an opening formed on the side face of the main body so that the first and second image forming sections slide in mutually orthogonal directions. With this arrangement, various maintenance operations of each unit can be performed while suppressing a reduction in strength of the main body, whereby degradation of image quality with life can be avoided for a long period of time.

10 Claims, 10 Drawing Sheets

⊙ : R
⊗ : S
Q
P
9
62a
62
61
13b
63b
62b
26c
11
25c
25b
43
61a
25a
26b
26a
63a
61b
12
13a
4

IMAGE FORMING APPARATUS

FIELD OF THE INVENTION

The present invention generally relates to an image forming apparatus wherein cyan (C), magenta (M), and yellow (Y) color image forming units for forming color images are provided on one side of an intermediate transfer medium (such as an intermediate transfer belt), and a black (Bk) toner image forming unit is provided on the other side of the intermediate transfer medium, and particularly relates to an image forming apparatus whose members can be maintained with ease without reducing the strength of an apparatus main body.

BACKGROUND OF THE INVENTION

Conventionally, a so-called tandem-type image forming apparatus is known as an image forming apparatus for forming color images using cyan (C) toner, magenta (M) toner, yellow (Y) toner and black (Bk) toner. In this type of image forming apparatus, image forming units for respective colors C, M, Y and Bk, each including a photoreceptor drum and a developing section, are arranged in order from the upstream side in a transport direction of a recording sheet, and respective color toner images formed on the photoreceptor drums are superimposed on a recording sheet in order, thereby forming a color image on the recording sheet.

In the described conventional tandem-type image forming apparatus, even when forming monochrome (black-and-white) images, it is required to go through not only Bk image forming processes but also C, M, and Y color image forming processes, and thus it is difficult to perform a high speed printing of a black-and-white image which is expected to be performed most frequently.

In response, for example, Japanese Unexamined Patent Publication No. 341617/1993 (Tokukaihel 5- 341617, published on Dec. 24, 1993) discloses a structure which permits the formation of images at high speed almost as high as the speed of image forming apparatuses for forming only black-and-white images, wherein C, M and Y color recording processing sections adopting an intermediate transfer system are provided separately from a black-and-white recording processing section, and a tandem system is adopted between the color recording processing sections and the black-and-white recording processing section.

The described conventional image forming apparatus is arranged such that a door formed on the front face (the user's side) of the apparatus main body in an axial direction of a photoreceptor is capable of opening and closing so that various maintenance operations of developing units and image holding member units (such as a refill for toner consumed, etc.) can be performed. Specifically, with the door opened, a developing unit or an image holding member unit is pulled out of the apparatus by sliding it along the axial direction to allow an maintenance operation of the units such as a refill for toner consumed, etc., to be performed.

FIG. 10 shows an example of the image forming apparatuses adopting the above sliding mechanism. In this image forming apparatus, toner image forming stations 101 to 104 for respective colors C, M, Y and Bk are disposed so as to surround an intermediate transfer belt.

The toner image forming stations 101 and 104 respectively include image holding member units 101*a* and 104*a*, and developing units 101*b* and 104*b*. Further, each of the image holding member units 101*a* and 104*a* includes a photoreceptor for forming thereon an electrostatic latent image according to image data. The developing units 101*b* and 104*b* are provided for developing electrostatic latent images formed on respective surfaces of the photoreceptors using toner. Similarly, the toner image forming stations 102 and 103 are provided with the image holding member units and the developing units respectively. The respective image holding member units and the developing units of the toner image forming stations 101 to 104 are all slidable in the axial direction of the photoreceptors, and the front face of the apparatus main body is positioned at one end in the axial direction of the photoreceptors. Further, a door 105 is formed on the front face of the apparatus main body so as to be capable of opening and closing.

According to the foregoing structure, with the door 105 opened, by pulling a predetermined unit subjected to the maintenance operation in the axial direction of the photoreceptors, maintenance operations of the predetermined unit can be performed. Further, upon completing the maintenance operation, by pushing back the predetermined unit to its installation position in the apparatus main body, and closing the door 105, a normal copying operation can be performed.

However, according to the structure shown in FIG. 10, all the toner image forming stations 101 to 104 slide along the axial direction, and thus the size of the door 105 formed in the axial direction is needed to be large. It is therefore required to form a large opening 106 for the door 105 in the support frame on the front face of the apparatus main body, which results in a reduction in strength of the main body apparatus. This problem becomes serious especially when using the apparatus with the main body apparatus tilted for a long time, as a damage on an element (mirror, LSU, etc.) which requires high precision may occurs due to the reduction in strength, thereby leading to a problem of a displacement of respective color toner images.

SUMMARY OF THE INVENTION

It is an object of the present invention to provide an image forming apparatus in which various maintenance operations of each unit can be performed while maintaining a sufficient strength of an apparatus main body, whereby degradation of image quality with life can be avoided for a long period of time.

In order to achieve the above object, an image forming apparatus of the present invention is characterized by including:

- a plurality of image forming stations for respectively forming images in different colors,
- wherein at least one of the plurality of image forming stations and rest of the plurality of image forming apparatuses are slidable in mutually different directions respectively through openings formed on an apparatus main body in respective sliding directions.

According to the above arrangement, the image forming stations corresponding to respective colors do not slide all in the same direction, but in two different directions. Here, the number of image forming stations which slide in each direction is not limited, and one or a plurality of image forming stations may slide in each direction. In any case, the image forming stations slide in mutually different directions through respective openings formed on the apparatus main body in respective sliding directions.

For example, in the case where one of the openings is formed in the axial direction of image holding members provided in the image forming stations, respective image forming stations being aligned in parallel in a direction orthogonal to the axial direction. In the conventional arrangement, all the image forming stations slide in the axial direction, and thus the opening formed in the axial direction is required to have a large size, and thus the reduction in strength of the apparatus main body having the opening cannot be avoided.

However, according to the arrangement of the present invention, by dividing the sliding direction of the image forming stations into two, for example, the number of image forming stations which slide in the axial direction of the image holding members provided in the image forming stations can be simply reduced. As a result, a size of the opening formed in the axial direction can be made smaller, and thus a reduction in strength of the apparatus main body can be suppressed. Therefore, even in the case where the apparatus is used for a long time with an apparatus main body tilted due to installation condition, the resulting displacement of each image forming station inside the apparatus can be prevented without causing a distortion in the apparatus main body. As a result, a displacement of images formed by the image forming stations for respective colors can be suppressed, and thus a degradation of image quality can be avoided. Moreover, since each of the image forming stations is slidably mounted, maintenance operations of respective image forming stations can be surely performed.

In order to achieve the above object, another image forming apparatus is characterized by including:

a first image forming section for forming an image;

a second image forming section for forming an image in different color from the image formed by the first image forming section; and an intermediate transfer medium disposed between the first image forming section and the second image forming section, wherein the image formed by the first image forming section and the image formed by the second image forming section are transferred onto a recording medium by the intermediate transfer medium, and the first image forming section and the second image forming section are slidable in mutually different directions respectively through openings formed on an apparatus main body in respective sliding directions.

In the above structure, first image forming section may be a group of image forming stations for respectively forming color images in different colors. On the other hand, the second image forming section may be an image forming station for forming images in different color from that of the above color images, such as a black-and-white image.

According to the above structure of having the intermediate transfer medium between the first image forming section and the second image forming section, for example, a black-and-white image formed by the second image forming section can be transferred onto a recording medium in a circulation of the intermediate transfer medium from the second image forming section to the first image forming section. Namely, the black-and-white image can be transferred onto the recording medium without passing through a transfer region for color image on the intermediate transfer medium. As a result, a high speed copying of a black-and-white image can be performed.

According to the above structure, the first image forming section and the second image forming section do not slide in the same direction, but in mutually different directions through respective openings formed on the apparatus main body in respective sliding directions. In this case, the size of the opening formed in each sliding direction can be set according to the size of the first image forming section or the second image forming section. Therefore, compared with the case wherein both the first image forming section and the second image forming section slide in the axial direction of the image holding members provided in respective image forming stations, the size of each opening can be made significantly smaller.

Therefore, according to the above arrangement, by making each opening smaller, the reduction in strength of the apparatus main body can be suppressed. Therefore, even in the case where the apparatus is used for a long time with the apparatus main body tilted due to installation condition, the resulting displacement of each image forming station inside the apparatus can be prevented without causing a distortion in the apparatus main body. As a result, a displacement of an image formed by an image forming station in each color can be suppressed, and thus degradation of image quality with life can be avoided. Moreover, since each of the image forming stations is slidably mounted, maintenance operations of each image forming station can be surely performed.

The above image forming apparatus may be further arranged such that:

the first image forming section and the second image forming section include, for respective different colors, image holding members for holding electrostatic latent images according to the image data, the image holding members being rotatable about respective axes aligned in a same direction, and one of the first image forming section and the second image forming section is slidable in an axial direction of the image holding members, and other of the first image forming section and the second image forming section is slidable in a direction orthogonal to the axial direction.

According to the above structure, the first image forming section and the second image forming section slide in mutually orthogonal directions, and one of the sliding directions is the axial direction of the image holding members. Moreover, the first image forming section and the second image forming section are arranged such that the respective axial directions of the image holding members are aligned. Therefore, compared with the case of sliding both the first image forming section and the second image forming section in the axial direction of the image holding members, the number of image forming stations which slide in the axial direction can be reduced, and an area of the face of the image forming station vertical to the axes can be made smaller. As a result, the size of the opening formed in the axial direction corresponding to the vertical face can be surely reduced, and whereby a reduction in strength of the apparatus main body can be surely reduced.

In the above arrangement, one of the first image forming section and the second image forming section is provided for forming black-and-white images, and other of the first image forming section and the second image forming section is provided for forming color images.

According to the above arrangement, the image forming stations for forming color images and the image forming station for forming black-and-white images can be separately provided with the intermediate transfer medium in between. As a result, for example, in a circulation of the intermediate transfer medium, only a black-and-white image can be transferred onto a recording medium via the intermediate transfer medium, which permits a high speed copying of the black-and-white image.

The above image forming apparatus may be further arranged such that the first image forming section is slidable in an axial direction of the image holding members, and the second image forming section is slidable in a direction orthogonal to the axial direction.

According to the above arrangement, the opening in the axial direction of the image holding member can be set in consideration of only the size of the first image forming section for forming color images. Therefore, compared with the arrangement of sliding both the first image forming section and the second image forming section in the axial direction, the size of the opening in the axial direction can be made significantly smaller, thereby surely suppressing a reduction in strength of the apparatus main body.

Alternately, it may be arranged such that the first image forming section is slidable in a direction orthogonal to an axial direction of the image holding members, and the second image forming section is slidable the axial direction.

According to the above arrangement, the opening in the axial direction of the image holding member can be set in consideration of only the size of the second image forming section for forming black-and-white images. Therefore, compared with the arrangement of sliding both the first image forming section and the second image forming section in the axial direction, the size of the opening in the axial direction can be made significantly smaller, thereby surely suppressing a reduction in strength of the apparatus main body.

The forgoing image forming apparatus may further includes guide means for guiding sliding movements of the first image forming section or the second image forming section in such a manner that the first image forming section or the second image forming section is separated from or is in contact with the intermediate transfer medium interlocking with the sliding movements of the first image forming section or the second image forming section, respectively.

According to the above structure, for example, when sliding the first image forming section to be pulled out of the apparatus main body, the sliding movements of the first image forming apparatus are guided by the guide means so as to slide after being separated from the intermediate transfer medium. On the other hand, when sliding the first image forming apparatus to be mounted in its installation position of the apparatus main body, the sliding movements of the first image forming section are guided by the guide means so as to come in contact with the intermediate transfer medium upon completing its sliding movements. The above structure of guiding the sliding movements of the first image forming section can be applied to the second image forming section.

According to the foregoing arrangement, the first or second image forming section is not always in contact with the intermediate transfer medium in its sliding movements. As a result, a friction between the first or second image forming section and the intermediate transfer medium can be surely prevented, and thus a damage on the first image forming section, the second image forming section, and the intermediate transfer medium can be surely prevented.

Moreover, as the first image forming section or the second image forming section is separated from and is brought in contact with the intermediate transfer medium interlocking with its sliding movements by the guide means, a separately provided mechanism for preventing such problem (a lever for manually switching contact and non-contact between the first or second image forming section and the intermediate transfer medium) can be omitted.

Therefore, according to the forgoing arrangement, the structure for preventing a friction between the first or second image forming section and the intermediate transfer medium can be achieved without increasing the number of the components. Moreover, sliding movements of the first and second image forming sections, and the switching between contact/non-contact between the first image forming section and the intermediate transfer medium can be performed simultaneously by the simple structure of adding the guide means.

The forgoing image forming apparatus may be arranged such that the first image forming section and the second image forming section include for respective different colors pairs of i) image holding member units for forming electrostatic latent images according to image data and ii) developing units for developing the electrostatic latent images.

According to the above arrangement, maintenance operations of the image holding member units and the developing units for respective colors can be performed simultaneously by the sliding movements of the first and second image forming sections.

The forgoing image forming apparatus may be arranged such that each of the image holding member units includes a developing section for developing an electrostatic latent image formed on an image holding member with toner in corresponding color, and a developer vessel for supplying the toner to the developing section.

According to the above arrangement, various maintenance operations of the developing section and the developing vessel which constitute each developing unit can be performed simultaneously by sliding the first and second image forming sections.

The forgoing image forming apparatus may be arranged such that each of the image holding member units includes an image holding member for holding the electrostatic latent image, a charger for charging a surface of the image holding member, and a cleaning unit for cleaning the surface of the image holding member.

According to the foregoing arrangement, various maintenance operations of the image holding member, the charger and the cleaning unit which constitute each image holding member unit can be performed simultaneously by sliding the first and second image forming sections.

For a fuller understanding of the nature and advantages of the invention, reference should be made to the ensuing detailed description taken in conjunction with the accompanying drawings.

BRIEF DESCRIPTION OF THE DRAWINGS

FIG. 8(*b*) is an explanatory view showing the structure of the sliding mechanism of FIG. 8(*a*) wherein the lower image forming section is pulled out of the image forming apparatus.

FIG. 9(*b*) is an explanatory view showing the structure of the sliding mechanism of FIG. 9(*a*) wherein the upper image forming section is pulled out of the image forming apparatus.

DESCRIPTION OF THE EMBODIMENTS

First Embodiment

The following descriptions will explain one embodiment of the present invention in reference to Figures.

Figure 2:
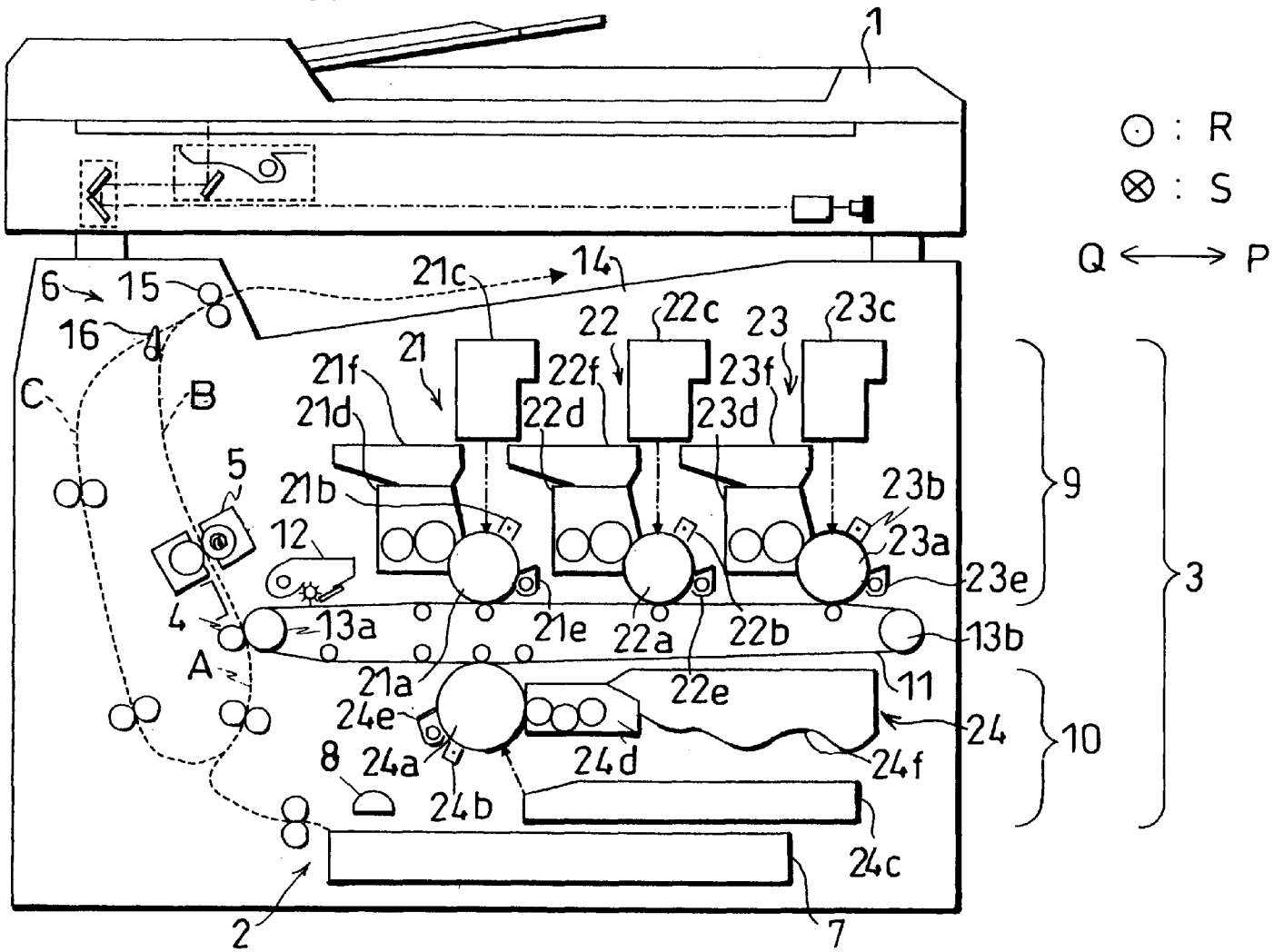
FIG. 2 is an explanatory view showing structures of the image forming stations.

As shown in FIG. 2, an image forming apparatus of the present embodiment includes a document reading section 1, a feeder 2, an image forming device 3, a transfer roller 4, a fixing section 5, and a transport section 6.

The document reading section 1 for reading an original image is provided above the apparatus main body. The feeder 2 provided under the apparatus main body includes a feed cassette 7 for storing recording sheets (recording medium), and a feed roller 8 for feeding recording sheets from the feed cassette 7 one by one.

The image forming device 3, provided between the document reading section 1 and the feeder 2, includes an upper image forming section 9 (first image forming section), a lower image forming section 10 (second image forming section), an intermediate transfer belt 11 (intermediate transfer medium) and a cleaning unit 12.

The intermediate transfer belt 11 is provided between the upper image forming section 9 and the lower image forming section 10 so as to be horizontally extended between two extension rollers 13*a* and 13*b* provided at respective ends. Namely, the upper image forming section 9 is provided on one side (on the upper side) of the intermediate transfer belt 11, and the lower image forming section 10 is provided on the other side (on the lower side) of the intermediate transfer belt 11. The intermediate transfer belt 11 is provided so as to circulate in a clockwise direction in FIG. 2.

The cleaning unit 12 is provided in a vicinity of the intermediate transfer belt 11 between the extension roller 13*a* and the upper image forming section 9. The cleaning unit 12 is provided for collecting residual toner remaining on the intermediate transfer belt 11.

The upper image forming section 9 and the lower image forming section 10 will be explained later in details.

The transfer roller 4 is provided at position opposing the extension roller 13*a*, so as to sandwich a transport path for a recording sheet in between.

The fixing section 5 is provided at the downstream side of the transport roller 4 in a transport direction of a recording sheet, for fixing the toner image transferred thereon. Since the feeder 2 is provided at the lower part of the apparatus main body, the recording sheet is transported upwards from the feeder 2. The fixing section 5 is therefore provided above the transfer roller 4.

The transport section 6 is provided for transporting the recording sheet fed from the feeder 2 to the discharge tray 14 provided on the upper surface of the apparatus main body via the transfer roller 4 and the fixing section 5. The transport section 6 includes a plurality of transport rollers including discharge rollers 15, and a switch gate 16.

The discharge rollers 15 are provided in a vicinity of a discharge tray 14 so as to be rotatable both in normal and reverse directions. Here, the rotations in the normal direction of the discharge rollers 15 indicate rotations in the transport direction of the recording sheet to the discharge tray 14. On the other hand, the rotations in the reverse direction of the discharge rollers 15 indicate rotations in the direction of feeding the recording sheet inside the apparatus. When the rear end of the recording sheet reaches the discharge rollers 15, the discharge rollers 15 starts rotation in the reverse direction to feed the recording sheet into the apparatus, to reverse the recording sheet, and the toner image is transferred onto the back surface of the recording sheet to be affixed thereon.

For convenience in explanations, a transport path of the recording sheet, extended from the feeder 2 to the fixing section 5 is defined to be a transport path A, and a transport path of the recording sheet, extended from the fixing section 5 to the discharge roller 14, is defined to be a discharge path B, and a transport path of the recording sheet fed inside the apparatus by the reverse rotations of the discharge rollers 15 extended to a confluence point with the transport path A is defined to be a re-transport path C. These transport path A, the discharge path B and the re-transport path C are formed substantially in vertical directions.

The switch gate 16 is provided for switching the transport path of the recording sheet so as to guide the recording sheet re-transported by reverse rotations of the discharge rollers 15 not to the discharge path B but to the re-transport path C. On the other hand, discharging the recording sheet to the discharge tray 14 via the discharge path B, the switch gate 16 is switched so as to ensure the transportation of the recording sheet without disturbances.

Next, the upper image forming section 9 and the lower image forming section 10 of the image forming device 3 will be explained.

The upper image forming section 9 includes image forming stations 21, 22 and 23 which are aligned in the circulating direction of the intermediate transfer belt 11. The image forming stations 21, 22 and 23 respectively form Y(yellow), M(mazenda), and C(cyan) color toner images. On the other hand, the lower image forming section 10 is provided with an image forming station 24 for forming a Bk (black) toner image. Namely, the upper image forming section 9 is provided for forming a color image, while the lower image forming section 10 is provided for forming a black-and-white image.

The image forming stations 21, 22 and 23 respectively include: photoreceptor drums 21*a*, 22*a* and 23*a* (image holding member), each having a photosensitive film on a peripheral surface thereof; chargers 21*b* 22*b* and 23*b* for charging respective surfaces of the photoreceptor drums 21*a*, 22*a* and 23*a*; LSUs (laser scanning units) 21*c*, 22*c* and 23*c* (exposure means) for forming electrostatic latent images on respective surfaces of the photoreceptor drums 21*a*, 22*a* and 23*a*; developing sections (developing units) 21*d*, 22*d* and 24*d* for developing electrostatic latent images formed on the respective surfaces of the photoreceptor drums 21*a*, 22*a* and 23*a* to be toner images; and cleaning units 21*e*, 22*e* and 23*e* for cleaning the respective surfaces of the photoreceptor drums 21*a* to 23*a* (removing residual toner remaining on the respective surfaces of the photoreceptor drums 21*a*, 22*a* and 23*a*).

Above the developing sections 21*d*, 22*d* and 23*d*, provided are developer vessels 21*f*, 22*f* and 23*f* for supplying developing material in respective colors of Y, M, and C to the corresponding developing sections 21*d*, 22*d* and 23*d*.

On the other hand, the image forming station 24 includes: a photoreceptor drum 24*a* (image holding member) having a larger diameter than those of the photoreceptor drums 21*a*, 22*a* and 23*a*; a charger 24*b* for charging the surface of the photoreceptor drum 24*a*; an LSU 24*c* (exposure means) for forming an electrostatic latent image on the surface of the photoreceptor drum 24*a*; a developing section 24*d* for developing the electrostatic latent image formed on the surface of the photoreceptor drum 24*a* to be a toner image; a cleaning unit 24*e* for cleaning the surface of the photoreceptor drum 24*a* (removing residual toner remaining on the surface of the photoreceptor drum 24*a*); and a developer vessel 24*f* for supplying a Bk developing material to the developing section 24*d*.

By adopting the photoreceptor drum 24*a* having a larger diameter than the diameters of the photoreceptor drums 21*a* to 23*a*, the photoreceptor drum 24*a* can be used for a long time even in consideration of possible reduction in film thickness of the photosensitive film over time. The image forming station 24 for forming black-and-white images is used more frequently than other image forming stations 21 to 23, and thus the accompanying reduction in film thickness of the photosensitive film is larger than those of the photoreceptor drums 21*a* to 23*a* of other image forming stations 21 to 23. Therefore, in the image forming apparatus of the present embodiment, the photoreceptor drum 24*a* having a larger diameter than those of other photoreceptor drums 21*a* to 23*a*, which are expected to be used less frequently than the photoreceptor drum 24*a*, is adopted, and thus a longer life of the photoreceptor drum 24*a* can be ensured, and an exchange of the photoreceptor drum 24*a* is needed less frequently.

The photoreceptor drum 24*a* is provided in a vicinity of the feed roller 8, and the developing section 24*d* is provided along the intermediate transfer belt 11 beside the photoreceptor drum 24*a*. Further, the developer vessel 24*f* is provided beside the developing section 24*d* on the opposite side of the photoreceptor drum 24*a*.

Namely, the image forming station 24 has a horizontally extended structure. The developer vessel 24*f* is formed larger both in the axial direction of the photoreceptor drum 24*a* and the horizontal direction orthogonal to the axial direction, so as to have a larger storage capacity of the developing material.

The photoreceptor drums 21*a* to 24*a* are rotatably provided, and the axes thereof are aligned in the same direction. The LSUs 21*c* to 24*c* are optical systems, each being composed of a polygon mirror and a fθ lens, etc.

In the image forming apparatus of the present invention, the photoreceptor drum, the charger and the cleaning unit for each color constitute an image holding member unit for forming an electrostatic latent image according to the image data. A developing device and a developer vessel for each color constitute a developer unit for developing an electrostatic latent image formed on the surface of the photoreceptor drum. In each image forming station, the image holding member unit and the developing unit for the corresponding color are connected.

As described, in the present embodiment, the image holding member unit and the developing unit are respectively arranged such that the respective members are formed in one integral parts. Therefore, for example, for the image holding member unit, maintenance operations of not only the photoreceptor drum, but also the charger and the cleaning unit can be performed with ease. Similarly, the developer unit, maintenance operations of not only the developing section but also the developer vessel can be performed with ease.

In the following, a unit in which the image holding member unit and the developer unit are connected is simply referred to as an image forming station. Therefore, in the following, the upper image forming section 9 and the lower image forming section 10 assume to have structures wherein image holding member units and developing units for the respective colors are connected.

Next, the image forming operation of the image forming apparatus will be explained.

In the case of forming a color image, first, the respective surfaces of the photoreceptor drums 21*a* to 24*a* are charged to predetermined potentials by the chargers. Then, based on the image data obtained by reading a document image by the document reading section 1, the LSUs 21*c* to 24*c* expose the respective surfaces of the photoreceptor drums 21*a* to 24*a*. As a result, on the respective surfaces of the photoreceptor drums 21*a* to 24*a*, electrostatic latent images in respective colors are formed according to the image data.

The electrostatic latent images formed on the surfaces of the photoreceptor drums 21*a* to 24*a* are developed into toner images in Y, M, C and Bk respectively by the developing sections 21*d* to 24*d*. The respective toner images are sequentially superimposed on the surface of the intermediate transfer belt 11, to be transferred thereto.

On the other hand, the recording sheet is transported to the transfer position between the intermediate transfer belt 11 and the transfer roller 4 via the transport path A from the feed cassette 7 by the feed roller 8 and other transport rollers. Then, the color toner image formed on the surface of the intermediate transfer belt 11 is copied to the recording sheet by the transfer roller 4. Thereafter, the color toner image is affixed on the recording sheet by the fixing section 5.

The recording sheet having the color toner image affixed thereon is transported to the discharge rollers 15 through the discharge path B. Then, in the case of forming an image only on one side of the recording sheet, the recording sheet is discharged without being treated by the normal rotations of the discharge rollers 15.

On the other hand, in the case of forming an image on both sides of the recording sheet, the discharge rollers 15 are rotated in the normal direction until the rear end of the recording sheet reaches the discharge rollers 15. When the rear end of the recording sheet reaches the discharge rollers 15, the discharge rollers 15 stop rotation with the recording sheet sandwiched in between, and the switch gate 16 is switched. Thereafter, the discharge rollers 15 start rotation in the reverse direction. As a result, the recording sheet is fed into the re-transport path C, and joints the transport path A, and is re-transported to the transfer position between the transfer roller 4 and the intermediate transfer belt 11. In the above transportation of the recording sheet, the recording sheet is reversed.

Thereafter, the above processes are repeated, and before discharging the recording sheet onto the discharge tray 14, the switch gate 16 is switched to its original position.

In the case of forming a monochrome image, only the image forming station 24 for Bk performs an image forming operation. Namely, based on the image data obtained by reading the document image by the document reading section 1, the LSU 24*c* exposes the surface of the photoreceptor drum 24*a*, thereby forming an electrostatic latent image on the surface of the photoreceptor drum 24*a*. Then, the electrostatic latent image is developed by the developing section 24*d* to from a black (Bk) toner image. When transferring the Bk toner image to the intermediate transfer belt 11, the toner image is transferred to the recording sheet transported between the intermediate transfer belt 11 and the transfer roller 4. The subsequent processes are the same as the aforementioned case of forming color images.

As described, in the present embodiment, color images formed by the upper image forming section 9 and the black-and-white image formed by the lower image forming section 10 are copied onto the recording sheet via the intermediate transfer belt 11 disposed between the upper image forming section 9 and the lower image forming section 10. With this arrangement, for example, a black-and-white image formed by the lower image forming section 10 can be copied to the recording sheet in the circulation of the intermediate transfer belt 11 from the lower image forming section 10 to the upper image forming section 9. As a result, a copying of a black-and-white image, which is expected to be performed more frequently than color images, can be performed at high speed.

The structure of the sliding mechanism of the upper image forming section 9 and the lower image forming section 10 with respect to the apparatus main body, which is the characteristic structure of the present invention will be explained.

The upper image forming section 9 and the lower image forming section 10 are capable of sliding in mutually different directions so as to be detachable from the apparatus main body. Specifically, in the present embodiment the upper image forming section 9 is slidable in the axial direction of the photoreceptor drum. On the other hand, the lower image forming section 10 is slidable in a direction orthogonal to the axial direction of the photoreceptor drums.

Figure 3:
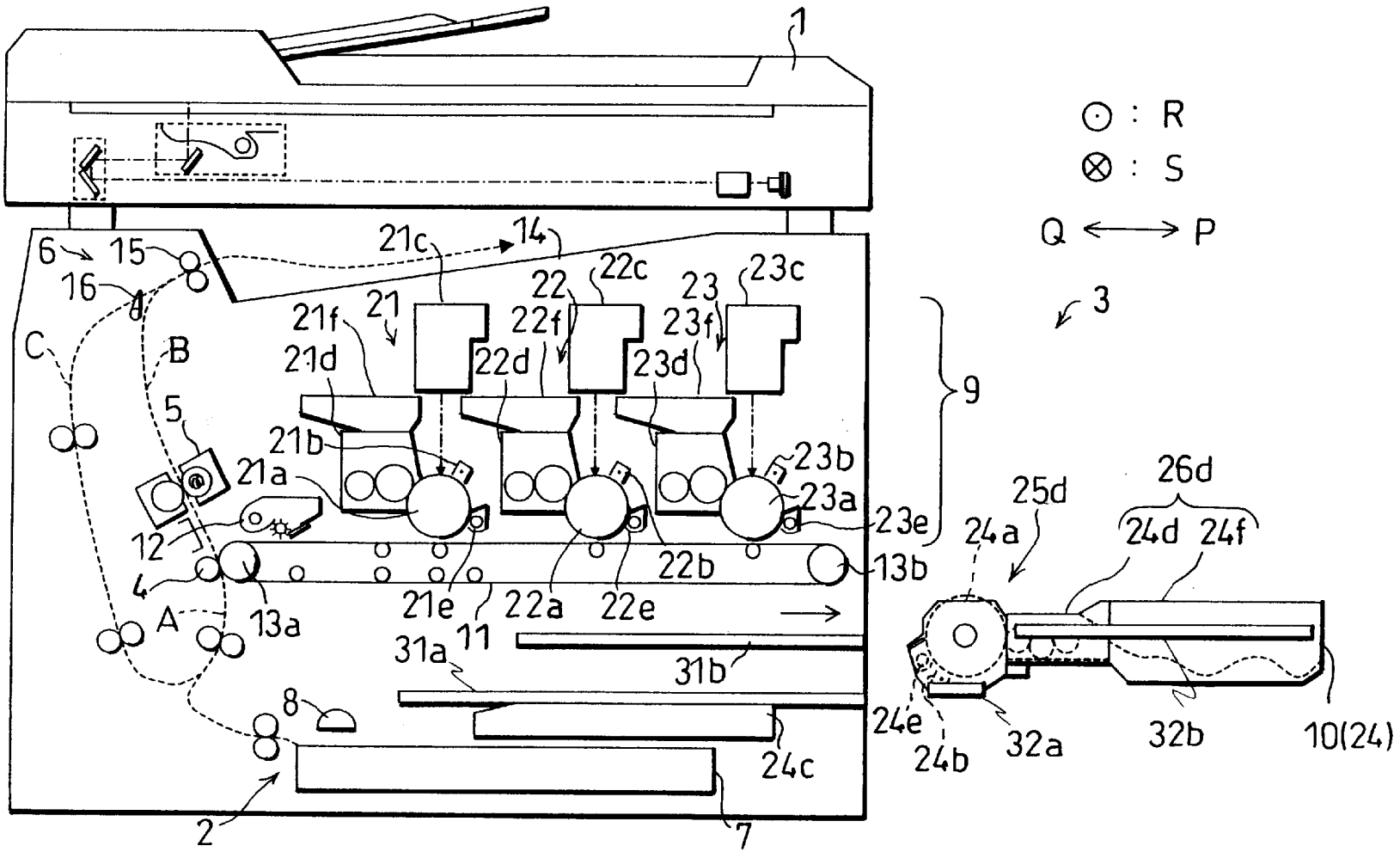
FIG. 3 is an explanatory view showing the structure of a sliding mechanism of the image forming apparatus, wherein the lower image forming section is pulled out of the image forming apparatus.

In order to realize the above structure of sliding mechanism, as shown in FIG. 3, guide rails 31*a* and 31*b* are formed for guiding the sliding movements of the lower image forming section 10. Further, in this lower image forming section 10, guides plates 32*a* and 32*b* are formed so as to be supported by the guide rails 31*a* and 31*b*. Similarly, guide rails (not shown) for guiding the sliding movements of the upper image forming section 9 are formed. Further, in this upper image forming section 9, also protrusions 33 (see FIG. 1) are formed so as to be supported by the guide rails.

For convenience in explanations, the respective directions in the image forming apparatus are defined as follows. Namely, the pulling direction of the lower image forming section 10 with respect to the apparatus main body is defined to be a P-direction, the p-direction being orthogonal to the axial direction of the photoreceptor drums (for example, the photoreceptor drum 21*a*), and the push-back direction of the lower image forming section 10 to its original installation position is defined to be a Q-direction. Similarly, the pulling direction of the upper image forming section 9 with respect to the apparatus main body is defined to be a R-direction, the R-direction being the axial direction of the photoreceptor drums, and the push-back direction of the upper image forming section 9 to its original installation position is defined to be an S-direction.

Therefore, the guide rails 31*a* and 31*b* for guiding the sliding movements of the lower image forming section 10 are formed so as to be extended along the PQ direction. On the other hand, the guide rails for guiding the sliding movements of the upper image forming section 9 are formed so as to be extended in the R–S direction. First, the sliding mechanism of the lower image forming section 10 will be explained.

Figure 1:
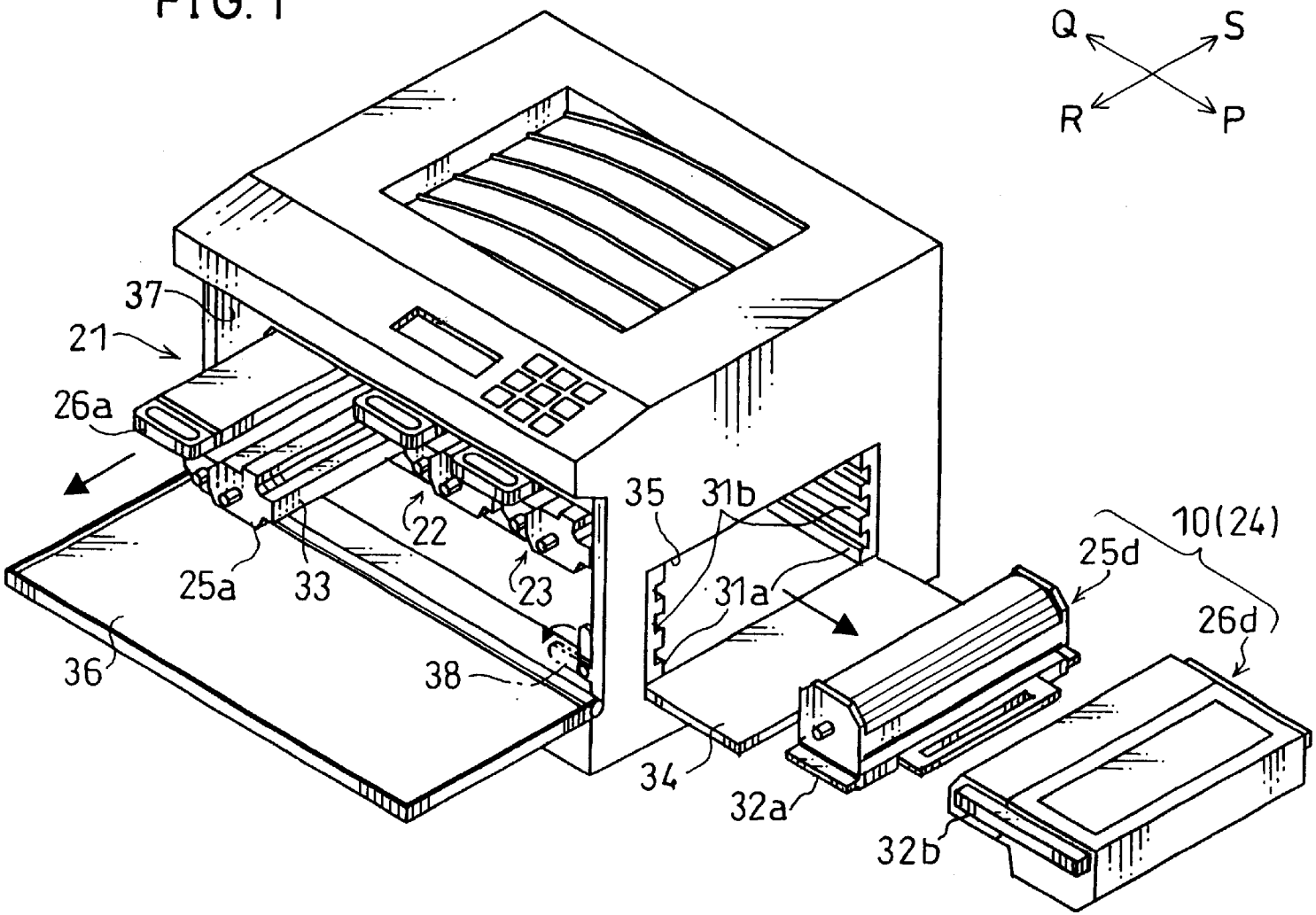
FIG. 1 shows an image forming apparatus in accordance with one embodiment of the present invention is a perspective view showing the state wherein image forming stations, which form images in different color respectively, slide in mutually different directions.

As shown in FIG. 1, the guide plates 32*a* are provided respectively under the R-side end face and the S-side end face of the image holding member unit 25*d* of the image forming station 24, so as to be extended in the P–Q direction. On the other hand, the guide plates 32*b* are provided respectively on the R-side face and the S-side face of the developing unit 26*d* of the image forming station 24 so as to be extended in the P–Q direction, at positions slightly above the centers of the respective side faces. Therefore, the guide plates 32*a* are provided at lower positions than the guide plates 32*b*.

As described, the developing section 24*d* and the developer vessel 24*f* of the developing unit 26*d* have a flat structure extended in the P–Q direction. Therefore, the guide plates 32*b* are formed longer in the P–Q direction than the guide plates 32*a*. In FIG. 1, however, the connection between the image holding member unit 25*d* and the developing section 26*d* is cancelled.

In replace of the described guide plates 32*a* and 32*b*, rollers which rotate on the guide rails 31*a* and 32*b* may be adopted. With this structure, the lower image forming section 10 can slide more smoothly in the P–Q direction.

As shown in FIG. 3, the guide rails 31*a* and 31*b* are provided so as to correspond to the guide plates 32*a* and 32*b* respectively, so that the lower image forming section 10 can slide in the P–Q direction while supporting the guide plates 32*a* and 32*b*. Therefore, the guide rails 31*a* are provided at lower positions than the guide rails 31*b*.

As shown in FIG. 1, in the present embodiment, the protrusions and recessions are formed on the inner side faces of the main body apparatus along the P–Q direction and alternately in the vertical direction, and the protrusions are used as guide rails 31*a* and 31*b*. Therefore, in the recessions formed directly above the projections of the guide rails 31*a* and 31*b*, the guide plates 32*a* and 32*b* are inserted respectively.

The guide rails 31*a* are formed slightly longer in the P–Q direction than the guide rails 31*b* (see FIG. 3), so as to enable the guide rails 31*a* to guide in the P–Q direction the guide plates 32*a* formed behind the guide plates 32*b* (in the Q-direction).

Namely, the sliding mechanism of the lower image forming section 10 is constituted by the guide rails 31*a* and 31*b* and the guide plates 32*a* and 32*b* for sliding the image forming station 24 in the P–Q direction.

The sliding mechanism for the upper image forming section 9 can utilize the sliding mechanism of the lower image forming section 10, basically without modifications. In the present embodiment, as shown in FIG. 1, for example, in the image holding member unit 25*a* of the image forming station 21, the protrusions 33 corresponding to the guide plates 32*a* are formed so as to be extended in the R–S direction. Similarly, in the developing unit 26*a*, the protrusions (not shown) corresponding to the guide plates 32*b* are formed as to be extended in the R–S direction. Then, by supporting the respective protrusions by the guide rails extended in the R–S direction, the sliding movements of the image forming station 21 in the R–S direction can be achieved. The respective sliding mechanisms for other image forming stations 22 and 23 of the upper image forming section 9 can be achieved in the same manner.

Namely, the sliding mechanism of the upper image forming section 9 is constituted by the guide rails for sliding the respective image forming stations 21 to 23 in the R–S direction, and the protrusions 33 corresponding to the guide plate 32*a*.

On the side face in the P-direction of the main body apparatus, an opening 34 is formed so as to be capable of opening and closing. This opening 34 is formed in a size just enough for pulling therethrough only the lower image forming section 10 (image forming station 24) out of the apparatus.

On the side face in the R-direction of the apparatus main body (front face of the apparatus main body), a door 36 is formed so as to be capable of opening and closing. This door 36 is formed in a size just enough for pulling therethrough only the respective image forming stations 21 to 23 of the upper image forming section 9 to the outside of the apparatus.

Further, in the apparatus main body, a lever is provided for separating respective image forming stations 21 to 24 from the intermediate transfer belt 11 when sliding respective image forming stations 21 to 24. Specifically, by switching this lever 38, when sliding any of the image forming stations 21 to 24, the extension rollers 13*a* and 13*b* (see FIG. 3) are moved outward (the extension roller 13*a* is moved in the Q-direction, and the extension roller 13*b* is moved in the P-direction), while other rollers than the extension rollers 13*a* and 13*b* in contact with the intermediate transfer belt 11 are moved inwards. As a result, the intermediate transfer belt 11 and each of the image forming stations 21 to 24 are separated, and thus friction between each of the photoreceptor drums 21*a* to 24*a* and the intermediate transfer belt 11 when pulling each of the image forming stations 21 to 24 out of the apparatus or pushing it back to its original installation position can be surely prevented, thereby surely preventing a damage on the photoreceptor drums 21*a* and 24*a* and the intermediate transfer belt 11.

After pushing respective image forming stations back to their original installation positions by switching the lever 38 to its original position, the extension rollers 13*a* and 13*b* as well as other rollers are moved back to their original positions. As a result, the respective photoreceptor drums 21*a* to 24*a* are brought in contact with the intermediate transfer belt 11 again, and images in respective colors can be transferred from the respective photoreceptor drums 21*a* to 24*a* to the intermediate transfer belt 11.

Next, the respective sliding movements of the upper image forming section 9 and the lower image forming section 10 will be explained.

When sliding respective image forming stations 21 to 24, first, the opening 34 on the side face or the door 36 on the front face of the apparatus main body is opened. Then, the lever 38 provided inside the apparatus is switched to move the intermediate transfer belt 11 backwards, and each of the photoreceptor drums 21*a* to 24*a* is separated from the intermediate transfer belt 11.

Figure 4:
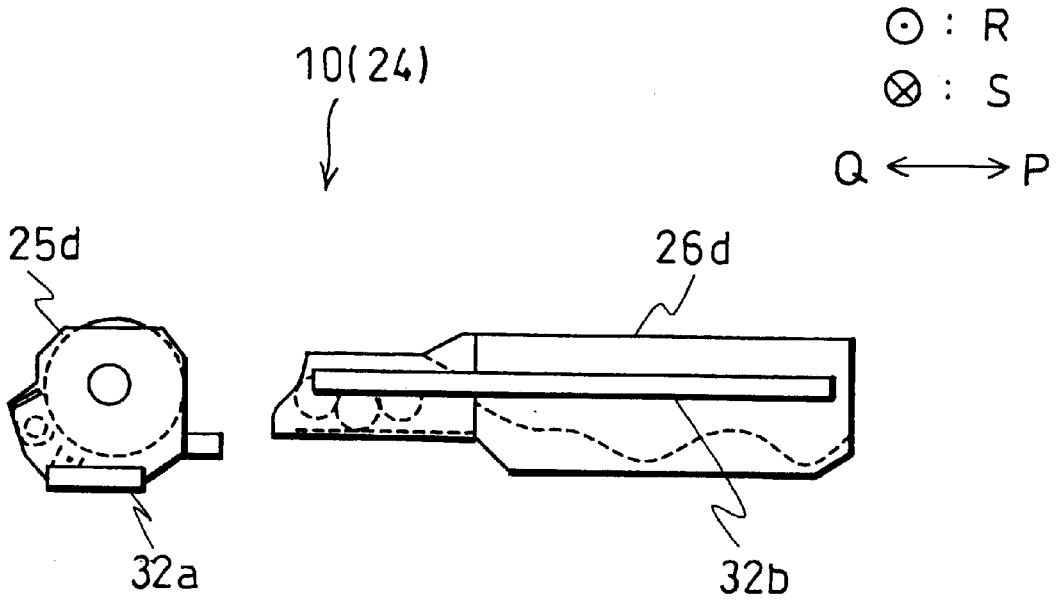
FIG. 4 is an explanatory view showing the state wherein the lower image forming section is divided into an image holding member unit and a developing unit.
Figure 5:
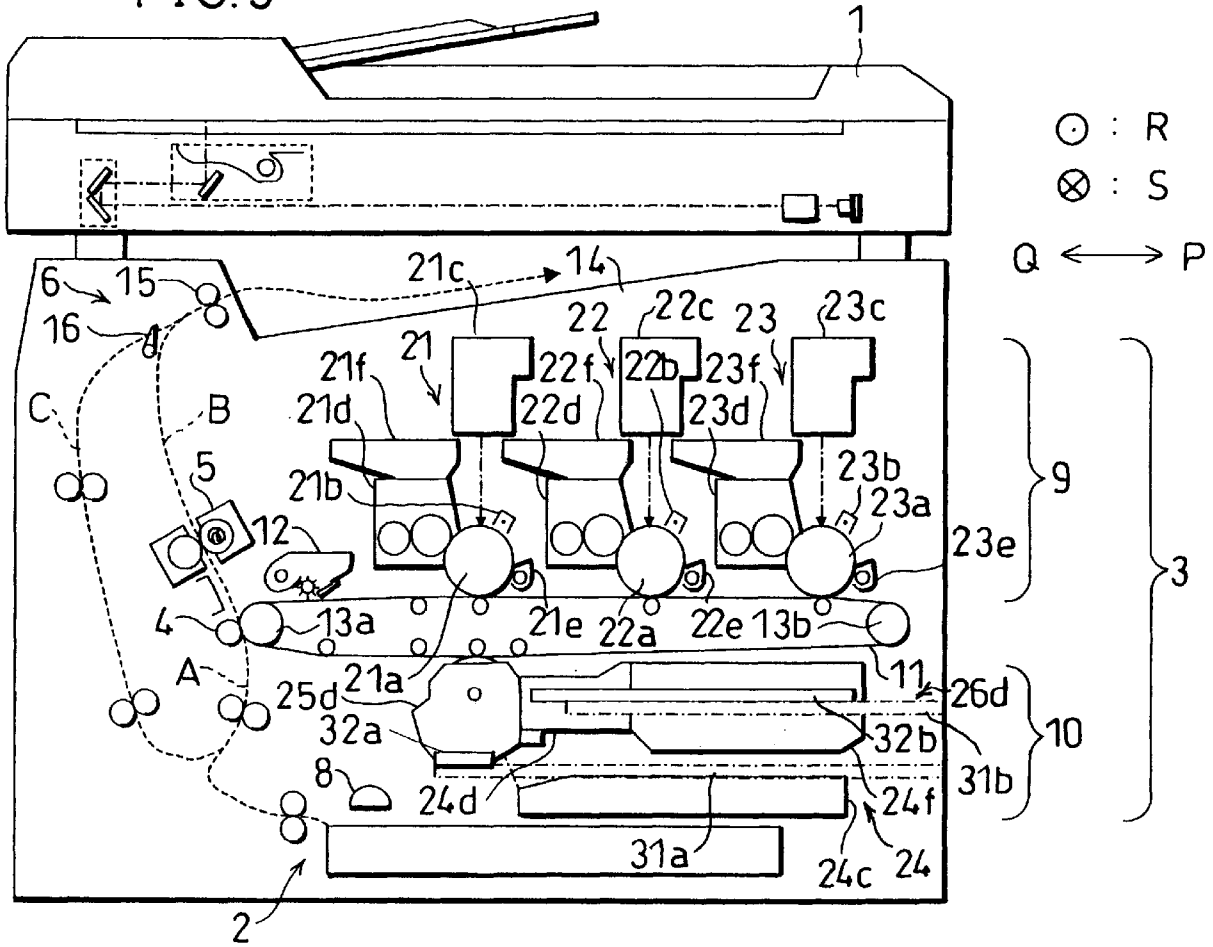
FIG. 5 is an explanatory view showing the state wherein the lower image forming section is mounted in the apparatus main body.

In the lower image forming section 10, the image forming station 24 is pulled (see FIG. 3) in the P-direction along the guide rails 31*a* and 31*b* via the opening 35. Then, as shown in FIG. 1 and FIG. 4, by cancelling the connection between the developing unit 26*d* and the image holding member unit 25*d*, maintenance operations of the developing unit 26*d* and the image holding member unit 25*d* in the image forming station 24 can be performed such as a refill for black toner consumed, etc. Upon completing each maintenance operation, as shown in FIG. 5, the guide plates 32*a* and 32*b* are placed on the guide rails 31*a* and 31*b* respectively to push back the image forming station 24 in the Q-direction to be stored in the apparatus main body.

On the other hand, in the image forming section 9, a predetermined image forming station is pulled in the R-direction along the guide rails through the opening 37. As a result, in this image forming station, the maintenance operation of the developing unit or the image holding member unit such as a refill for toner consumed, etc., can be performed. Upon completing each maintenance operation, the image forming station is pushed back in the S-direction along the guide rails to its original installation position in the apparatus main body.

Then, the lever 38 is switched back to the original position to make the respective photoreceptor drums 21*a* to 24*a* contact the intermediate transfer belt 11. Then, the doors 34 and 36 are closed to set the apparatus in the stand-by state for forming an image.

As described, in the present embodiment, all of image forming stations for respective colors are separated into two groups: i) the upper image forming section 9 provided on one side of the intermediate transfer belt 11; and ii) the lower image forming section 10 provided on the other side of the intermediate transfer belt 11. Further, the upper image forming section 9 and the lower image forming section 10 are slidable in mutually different directions through the respective openings 37 and 35 formed when the doors 36 and 34 are opened respectively.

According to the foregoing arrangement, the door 36 and the opening 37 on the front side can be formed in size corresponding to the image forming sections for three colors (image forming stations). Then, as compared to the structure wherein all the image forming stations for four colors are pulled out of the apparatus in the same direction, the above structure of the present embodiment offers a reduction in size of the door 36 and the opening 37 on the front side. Moreover, as in the present embodiment, in the case of forming the intermediate transfer belt 11 between the upper image forming section 9 and the lower image forming section 10, the door 36 and the opening 37 can be formed in size in consideration of only the size of the upper image forming section 9, without considering the size of the intermediate transfer belt 11.

Therefore, according to the arrangement of the present embodiment, the size of the door 36 and the opening 37 at on the front face can be made smaller, and thus a reduction in strength of the main body device can be suppressed. As a result, even when the apparatus has been used for a long time with the apparatus main body tilted due to the installation conditions, image quality degradation can be avoided by preventing a displacement in position of the toner images in respective colors. Moreover, each unit is detachable from the apparatus main body by the sliding mechanism, and thus a maintenance operation of each unit can be surely performed.

In the structure of the foregoing embodiment, two openings are formed on the apparatus main body; however, these openings hardly affect the strength of the apparatus main body for the following reasons: i) only one additional opening is formed as compared to the conventional arrangement; the sizes of respective two openings can be made small; and the two openings are formed in different sides of the apparatus main body in respective sliding directions.

Second Embodiment

The following descriptions will explain another embodiment of the present invention in reference to Figures. For members having the same functions as the aforementioned embodiment will be designated by the same reference numerals, and the descriptions thereof shall be omitted here.

The image forming apparatus of the present embodiment has the same structures of the image forming apparatus of the previous first embodiment except for the following structure. That is, in the present embodiment, the upper image forming section 9 is capable of sliding in the direction (P–Q direction) orthogonal to the axial direction of each photoreceptor drum. On the other hand, the lower image forming section 10 is provided so as to be capable of sliding in the axial direction (R–S direction) of each photoreceptor drum.

Figure 6:
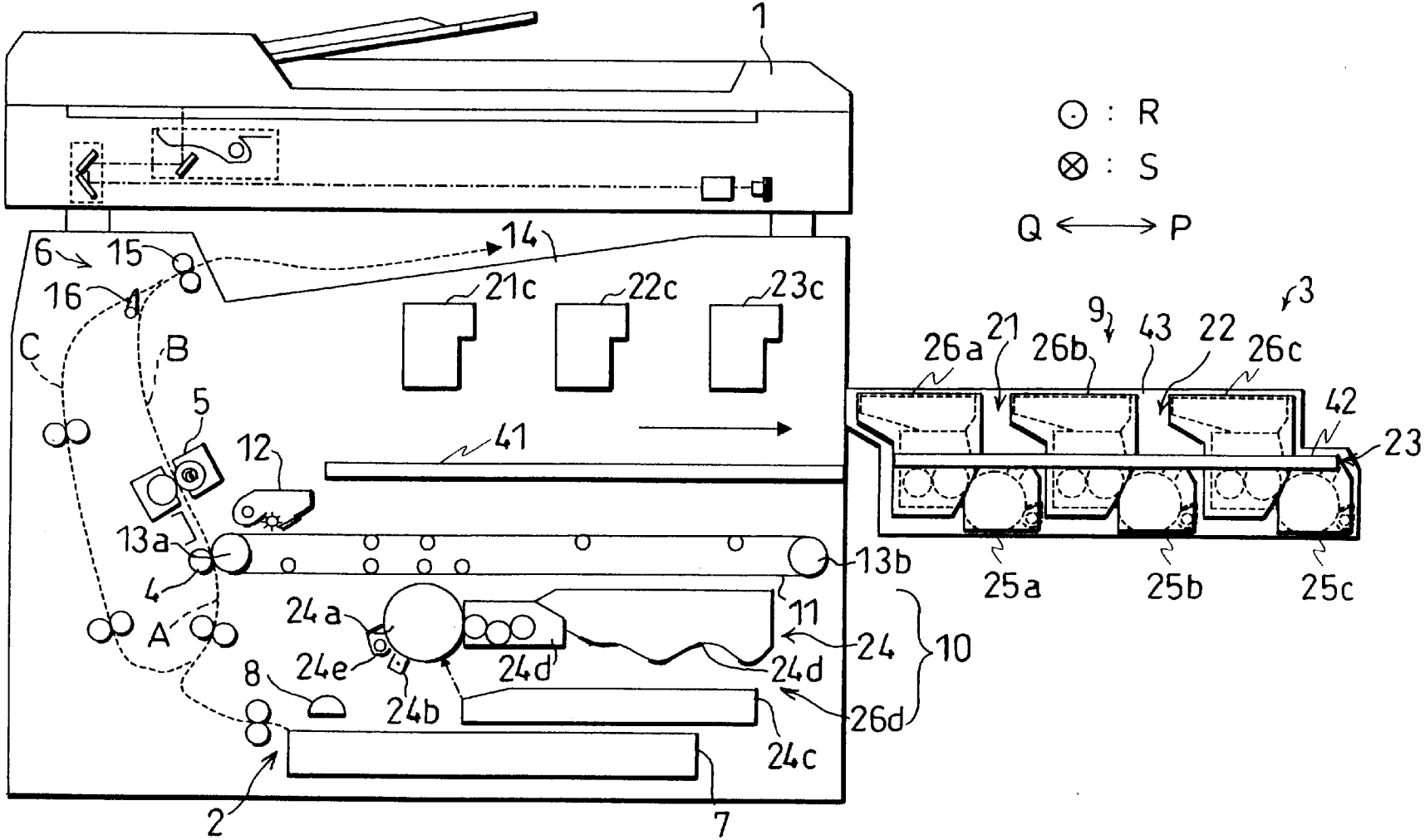
FIG. 6 is an explanatory view showing the structure of a sliding mechanism of an image forming apparatus in accordance with another embodiment of the present invention, wherein the upper image forming section is pulled out of the image forming apparatus.

In order to achieve the structure of the present embodiment, as shown in FIG. 6, in the apparatus main body, guide rails 41 are formed so as to be extended in the P–Q direction, for guiding the sliding movements of the upper image forming section 9. In this upper image forming section 9, guide plates 42 are formed so as to be supported by the guide rails 41.

The guide plates 42 are formed substantially at centers of the respective side faces in the R-direction and the side faces in the S-direction of the developing units 26*a*, 26*b* and 26*c* in the image forming stations 21 to 23 of the upper image forming section 9 so as to be extended in the P–Q direction. The respective image forming stations 21 to 23 are stored in a cabinet 43 as one integral part.

The guide rails 41 correspond to respective guide plates 42 so as to enable the sliding movements of the upper image forming section 9 in the P–Q direction by supporting the guide plates 42.

Namely, the guide rails 41 and the guide plates 42 for sliding respective image forming stations 21 to 23 in the P–Q direction constitute a sliding mechanism of the upper image forming section 9.

In the apparatus main body, the guide rails (not shown) for guiding the sliding movements of the lower image forming section 10 are formed so as to be extended in the R–S direction, and, members (not shown) to be supported by the guide rails, are provided for example, in the image holding member unit 25*d* and the developing unit 26*d* of the lower image forming section 10. Namely, the sliding mechanism of the lower image forming section 10 is constituted by the guide rails and the members to be supported by the guide rails.

In the present embodiment, the door 36 and the opening 37 (see FIG. 1) formed on the front face of the apparatus have a size just enough for pulling therethrough the image forming station 24 out of the apparatus, and the door 34 and the opening 35 (see FIG. 1) formed on the side face have a size just enough for pulling therethrough the image forming stations 21 to 23 out of the apparatus.

According to the above arrangement, either the door 34 formed on the side face of the apparatus main body or the door 36 formed on the front face of the apparatus main body is opened and the lever 38 (see FIG. 1) inside the apparatus is switched to move the intermediate belt 11 backwards. Then, in the case of the image forming section 9, the image forming stations 21 to 23 are pulled through the opening 35 in the P-direction out of the apparatus along the guide rails 41. Then, the respective image forming stations 21 to 23 are taken out of the cabinet 43, and respective connections between the developing units and the image holding member units are cancelled. As a result, a maintenance operation of the developing unit or the image holding member unit, such as a refill for toner consumed, etc. can be performed in each image forming station.

Figure 7:
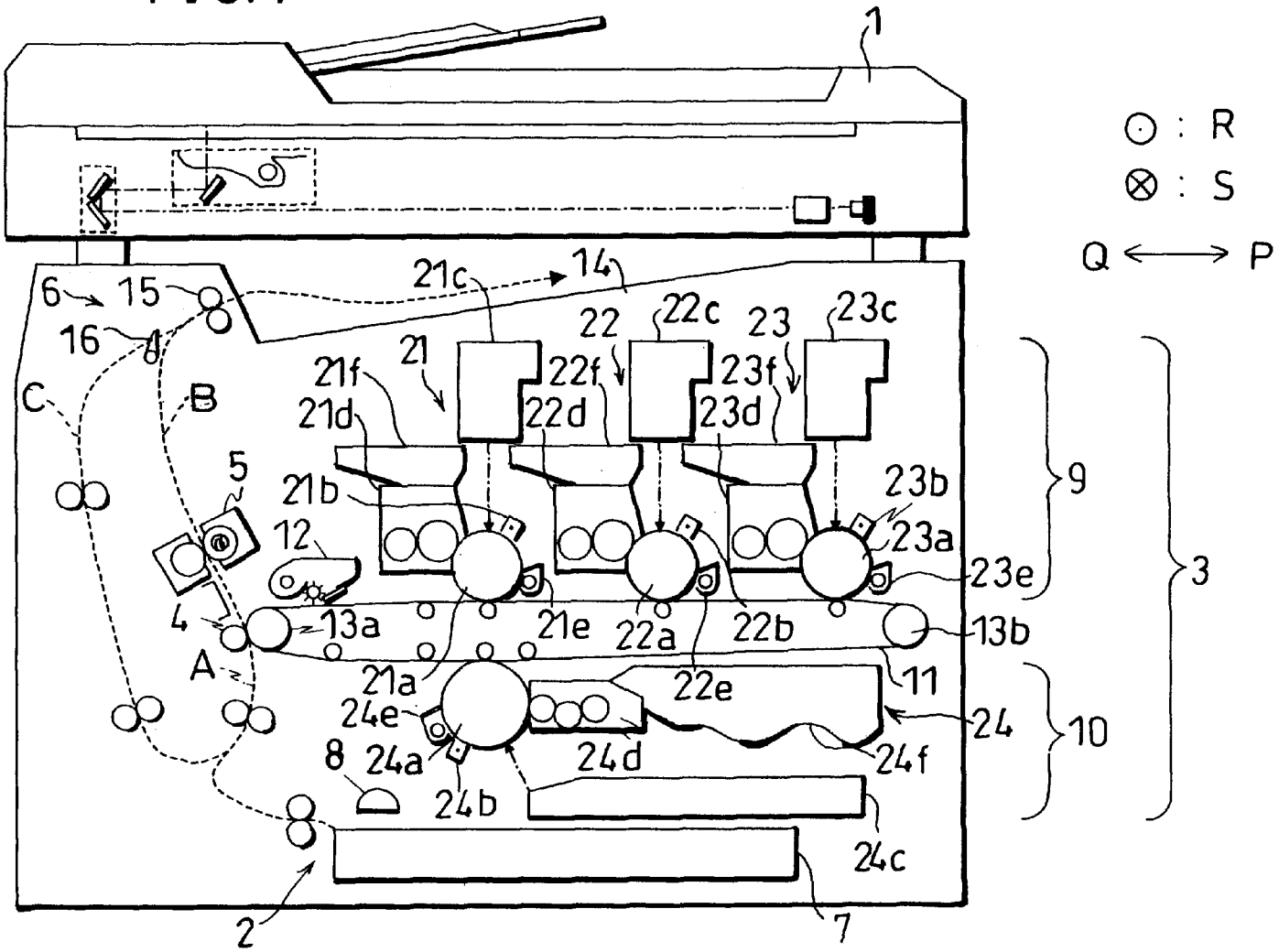
FIG. 7 is an explanatory view showing the state wherein the upper image forming section is mounted in the apparatus main body.

After completing various maintenance operations, the respective image forming stations 21 to 23 are stored in the cabinet 43. Then, as shown in FIG. 7, the guide plates 42 are mounted on the guide rails 41, and the cabinet 43 (image forming stations 21 to 23) is mounted on the guide rails 41 to be pushed it back in the Q-direction, to its installation position in the apparatus main body.

On the other hand, in the lower image forming section 10, the image forming station 24 is pulled in the R-direction through the opening 37 out of the apparatus along the guide rails. As a result, in the image forming station 24, maintenance operations of the developing unit 26*d* or the image holding member unit 25*d* such as refill for black color consumed, etc., can be performed. After completing the various maintenance operations, the image forming station 24 is pushed back in the S-direction along the guide rails to be set in its original installation position in the apparatus main body.

Then, the lever 38 is switched back to its original position, to allow the respective photoreceptor drums 21*a* to 24*a* contact the intermediate transfer belt 11 respectively. Then, the doors 34 and 36 are closed to set the apparatus in the stand-by state for forming images.

As described, the present embodiment is arranged such that the upper image forming section 9 is slidable in the P–Q direction, and the lower image forming section 10 is slidable in the R–S direction. In this way, the door 36 and the opening 37 on the front face of the apparatus for pulling therethrough the lower image forming section 10 out of the apparatus can be formed in size just enough for only one color image forming station. Therefore, as compared to the case wherein all of the image forming stations for four colors are pulled out of the apparatus in the same direction, the door 36 and the opening 37 can be made significantly smaller. Moreover, as in the case of the first embodiment, the respective sizes of the door 36 and the opening 37 can be set without considering the size of the intermediate transfer belt 11.

Therefore, according to the structure of the present embodiment, the door 36 and the opening 37 on the front face of the apparatus can be made smaller, thereby achieving the same effects as achieved from the structure of the first embodiment.

Additionally, according to the foregoing arrangement, the three image forming stations for three colors C, M and Y are pulled out of the apparatus in the P–Q direction. However, since these three image forming stations are aligned in the pulling direction, the door 34 and the opening 35 can be formed in size just enough for passing therethrough only one image forming station (for example, image forming station 23). Namely, the door 34 and the opening 35 need not have a large size, and thus reduction in strength of the apparatus main body can be avoided.

Third Embodiment

The following descriptions will explain still another embodiment of the present invention in reference to Figures.

For members having the same functions as the aforementioned first and second embodiments will be designated by the same reference numerals, and the descriptions thereof shall be omitted here.

The structure of the image forming apparatus of the present embodiment differs from the image forming apparatus of the first embodiment in that the photoreceptor drum 24*a* is brought in contact with and are separated from the intermediate transfer belt 11 automatically, interlocking with the sliding movements of the lower image forming section 10. In the following, this characteristic structure of the present embodiment will be discussed in details.

Figure 8A:
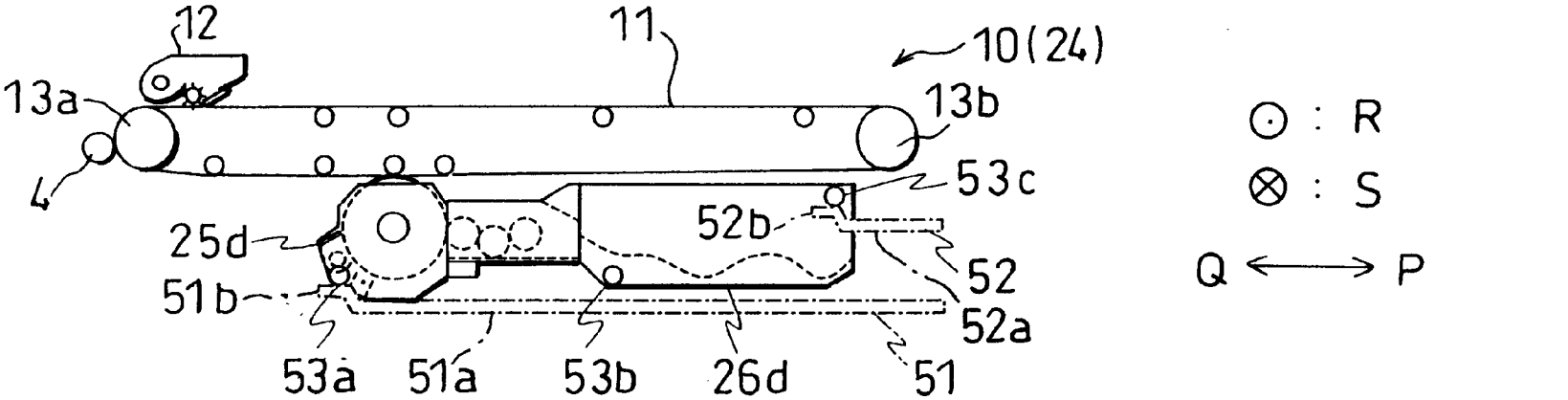
FIG. 8(*a*) is an explanatory view showing the structure of a sliding mechanism of an image forming apparatus in accordance with still another embodiment of the present invention wherein the lower image forming section is mounted in the apparatus main body.
Figure 8B:
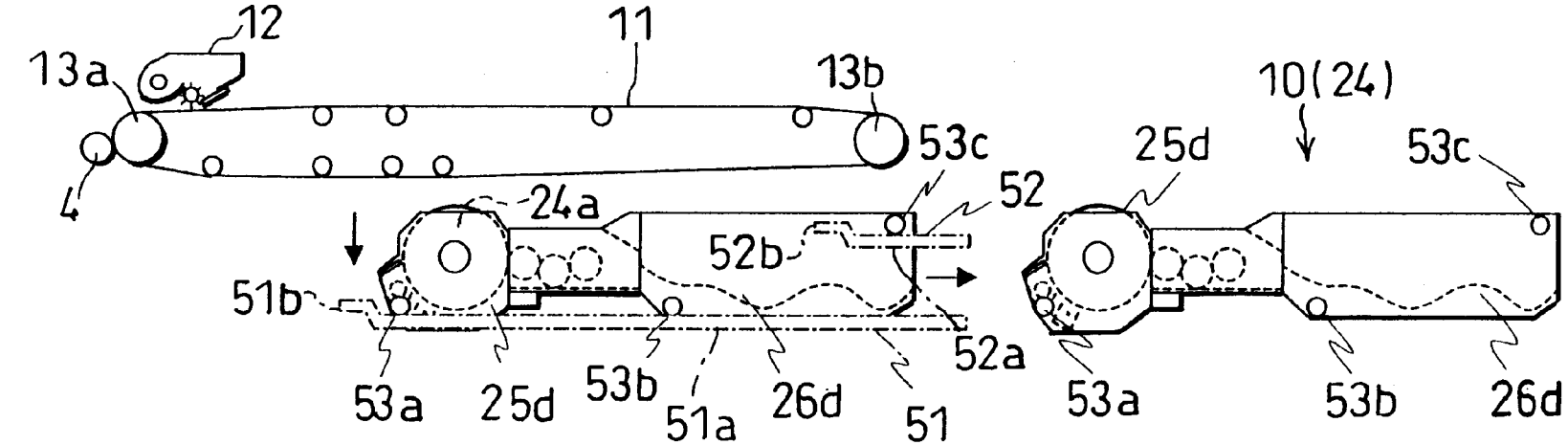

In the present embodiment, as shown in FIG. 8(*a*) and FIG. 8(*b*), guide rails 51 and 52 (guide means) are adopted in replace of the guide rails 31*a* and 31*b* shown in FIG. 3, and guide pins 53*a*, 53*b* and 53*c* (guide means) are adopted in replace of the guide plates 32*a* and 32*b* shown in FIG. 3.

The guide pin 53*a* is formed so as to be projected in the R-direction from the lower end portion of the side face in the R-direction of the image holding member unit 25*d* of the image forming station 24. The guide pins 53*b* and 53*c* are provided so as to be projected in the R-direction from the corner in the diagonal direction of the end face in the R-direction of the developing unit 26*d* in the image forming station 24. The guide pin 53*a* is provided substantially at the same height position as the guide pin 53*b* in the vertical direction, and the guide pin 53*c* is formed at higher position than the guide pin 53*b*. On the respective side faces in the S-direction of the image holding member unit 25*d* and the developing unit 26*d* of the image forming station 24, the guide pins 53*a*, 53*b* and 53*c* are formed so as to be projected in the S-direction at positions corresponding to respective positions of the guide pins 53*a*, 53*b* and 53*c* of the guide pins 53*a*, 53*b* and 53*c* on the side faces in the R-direction.

The guide rails 51 and 52 are provided for guiding the sliding movements of the lower image forming section 10 in the P–Q direction. The guide rails 51 and 52 respectively include horizontal parts 51*a* and 52*a* which are extended horizontally in the P–Q direction, and bent parts 51*b* and 52*b* which are bent upwards (to the side of the intermediate belt) from the ends in the Q-direction of the horizontal parts 51*a* and 52*a* and are bent again horizontally. The guide rails 51 are provided for supporting the guide pins 53*a* and 53*b*, and the guide rails 52 are provided for supporting the guide pin 53*c*. Therefore, the guide rails 52 are positioned above the guide rails 51.

Namely, the sliding mechanism of the lower image forming section 10 in the present embodiment is constituted by the guide rails 51 and 52 and the guide pins 53*a*, 53*b* and 53*c*.

According to the foregoing arrangement, in the state shown in FIG. 8(*b*) wherein the lower image forming section 10 is mounted in the apparatus main body, and the photoreceptor drum 24*a* of the image forming station 24 is in contact with the intermediate transfer belt 11, the guide pins 53*a* and 53*c* are supported by the bent parts 51*b* and 52*b* of the guide rails 51 and 52 respectively.

From the above state, with the sliding movements of the lower image forming section 10 in the P-direction, as shown in FIG. 8(*b*), the members supporting the guide pins 53*a* and 53*a* are switched from the bent parts 51*b* and 52*b* to the horizontal parts 51*a* and 52*a*. Here, with the movements of the guide pins 53*a* and 53*c* along the bent parts 51*b* and 52*b*, the lower image forming section 10 is moved downwards, i.e., to be away from the intermediate transfer belt 11.

When the guide pins 53*a* and 53*b* contact the horizontal part 51*a* of the guide rail 51, and the guide pin 53*c* contacts the horizontal part 52*a* of the guide rail 52, the lower image forming section 10 is pulled in the P-direction along the guide rails 51 and 52 in the state where the photoreceptor drum 24*a* is completely separated from the intermediate transfer belt 11.

On the other hand, when mounting the lower image forming section 10 into the apparatus, the lower image forming section 10 is inserted in the Q-direction along the horizontal parts 51*a* and 52*a* of the guide rails 51 and 52. When the guide pins 53*a* and 53*c* of the lower image forming section 10 reach the bent parts 51*b* and 52*b*, and the lower image forming section 10 is pushed further in the Q-direction. As a result, the guide pins 53*a* and 53*c* are moved onto the bent parts 51*b* and 52*b*, which raise the lower image forming section 10 upwards, and the photoreceptor drum 24*a* is brought into contact with the intermediate transfer belt 11 upon completing the installation of the lower image forming section 10.

As described, in the present embodiment, the guide pins 52*a*, 52*b* and 52*c* provided in the lower image forming section 10 are supported and guided by the guide rails 51 and 52. With this structure, the lower image forming section 10 is automatically brought into contact with and is separated from the intermediate transfer belt 11 interlocking with the sliding movements of the lower image forming section 10 in the P–Q directions. In the foregoing arrangement of the present embodiment having the interlocking structure, the lever 38 for manually separating the lower image forming section 10 from the intermediate transfer belt 11 can be omitted, and thus the present embodiment offers a simplified structure as compared to that of the first embodiment. Moreover, sliding movements of the lower image forming section 10, and the switching between contact/non-contact between the lower image forming section 10 and the intermediate transfer belt 11 can be performed simultaneously by the simple structure of adding the guide pins 52*a*, 52*b* and 52*c*, and guide rails 51 and 52.

The forgoing sliding mechanism in the P–Q direction of the lower image forming section 10 of the present embodiment is applicable to the sliding mechanism in the R–S direction of the lower image forming section 10 which will be explained in the following fourth embodiment.

Fourth Embodiment

The following descriptions will explain still another embodiment of the present invention in reference to Figures. For members having the same functions as the aforementioned first through third embodiments will be designated by the same reference numerals, and the descriptions thereof shall be omitted here.

The structure of the image forming apparatus of the present embodiment differs from the image forming apparatus of the second embodiment in that the respective photoreceptor drums 21*a* to 23*a* are brought in contact with and are separated from the intermediate transfer belt 11 automatically, interlocking with the sliding movements of the upper image forming section 9. This characteristic structure of the present embodiment will be discussed in details.

Figures 9A, 9B:
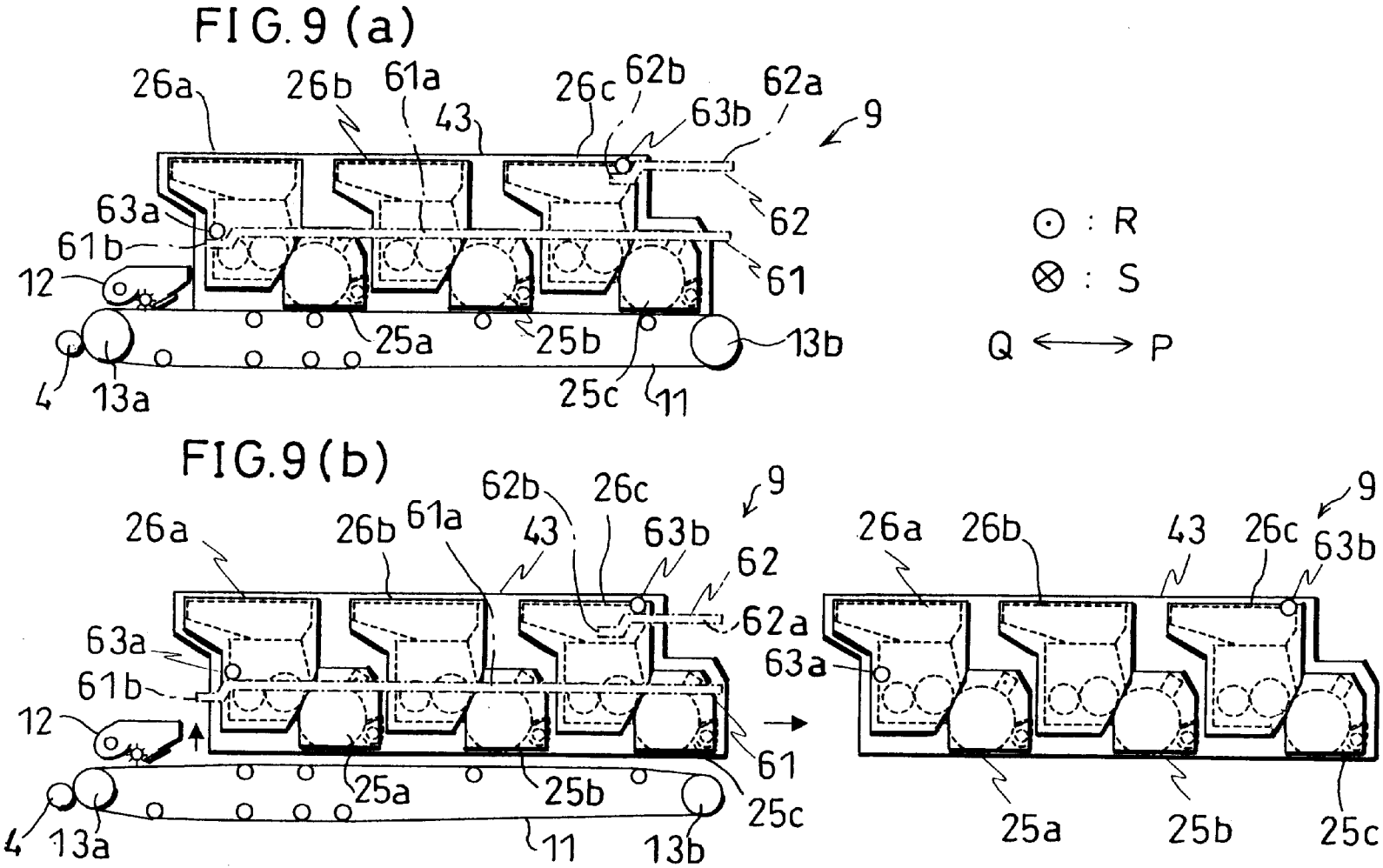
FIG. 9(*a*) is an explanatory view showing the structure of a sliding mechanism of an image forming apparatus in accordance with still another embodiment of the present invention wherein the upper image forming section is mounted in the apparatus main body.
Figure 10:
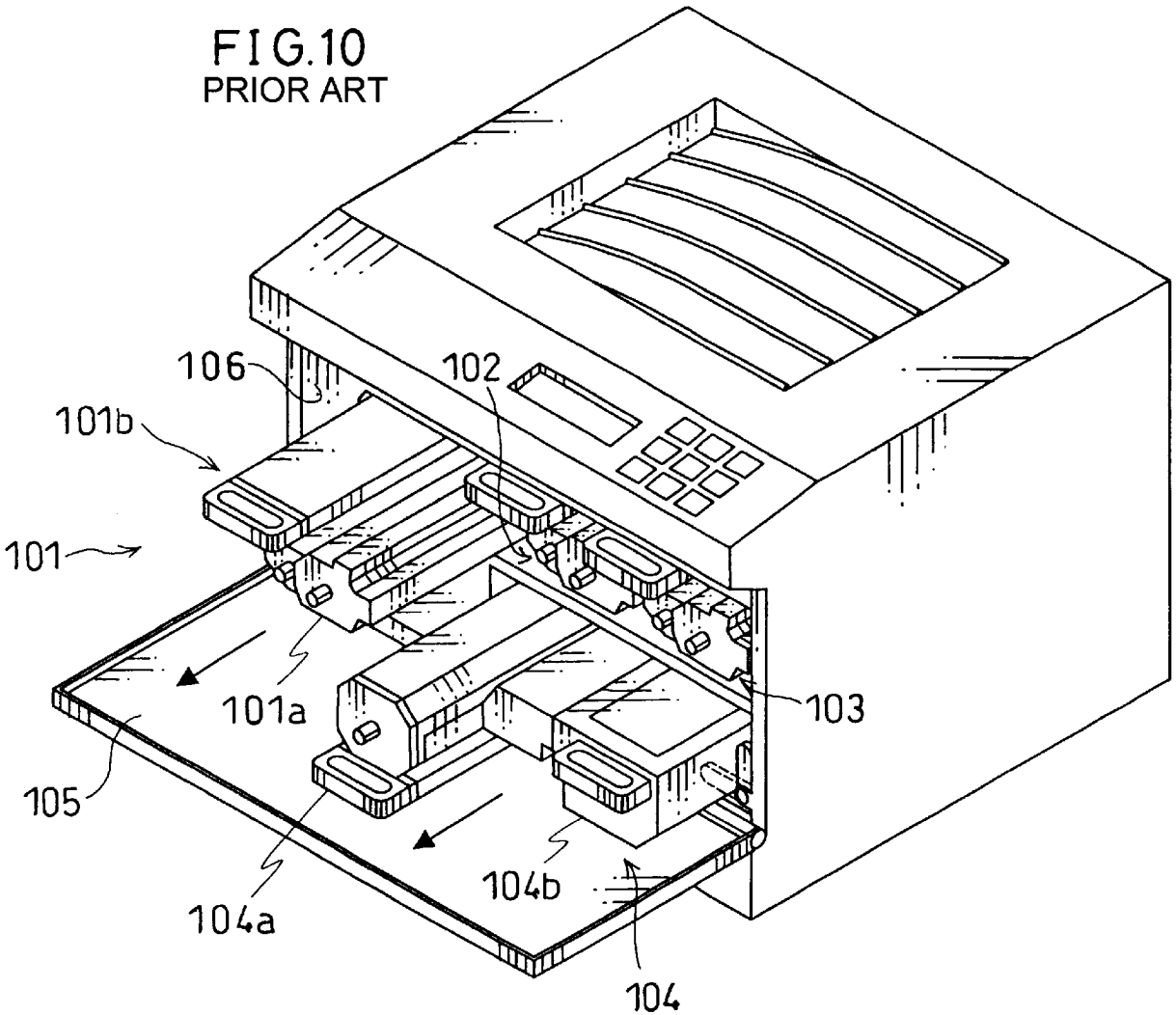
FIG.10 PRIOR ART
FIG. 10 is a perspective view showing the schematic structure of an image forming apparatus of the prior art wherein all the toner image forming stations for different colors slide in an axial direction of the photoreceptors.

In the present embodiment, as shown in FIG. 9(*a*) and FIG. 9(*b*), guide rails 61 and 62 (guide means) are adopted in replace of the guide rails 41 shown in FIG. 6, and guide pins 63*a* and 63*b* (guide means) are in replace of the guide plates 42 shown in FIG. 6.

The guide pin 63*a* is projected in the R-direction from the end face in the R-direction of the developing unit 26*a* of the image forming station 21, and the guide pin 63*b* is projected in the R-direction from the end face in the R-direction of the developing unit 26*c* of the image forming station 23. The guide pin 63*b* is provided at higher position than the guide pin 63*a*. These guide pins 63*a* and 63*b* are formed also on the side face in the S-direction of the developing unit 26*a* of the image forming station 21 and the end face in the S-direction of the developing unit 26*c* of the image forming station 23 so as to be projected in the S-direction, at positions corresponding to the positions of the guide pins 63*a* and 63*b* formed on the end faces in the R-direction.

Here, it may be arranged such that guide pins 63*a* and 63*b* are formed on the frame of the cabinet 43.

The guide rails 61 and 62 are provided for guiding the sliding movements of the upper image forming section 9 in the P–Q direction. The guide rails 61 and 62 respectively include horizontal parts 61*a* and 62*a* which are extended horizontally in the P–Q direction, and bent parts 61*b* and 62*b* which are bent slightly downwards (to the side of the intermediate belt 11) from the end portions in the Q-direction of the horizontal parts 61*a* and 62*a* and are then bent again horizontally. The guide rails 61 are provided for supporting the guide pins 63*a*, and the guide rails 62 are provided for supporting the guide pins 63*b*. Therefore, the guide rails 62 are provided at higher position than the guide rails 61.

Namely, in the present embodiment, the sliding mechanism of the upper image forming section 9 is constituted by the guide rails 61 and 62 and the guide pins 63*a* and 63*b*.

According to the foregoing arrangement, in the state shown in FIG. 9(*a*) wherein the upper image forming section 9 is mounted in the apparatus main body, and the photoreceptor drums 21*a* to 23*a* of the image forming stations 21 to 23 are in contact with the intermediate transfer belt 11, the guide pins 63*a* and 63*b* are supported by the bent parts 61*b* and 62*b* of the guide rails 61 and 62 respectively.

From the above state, with the sliding movements of the upper image forming section 9 in the P-direction, as shown in FIG. 9(*b*), the guide pins 63*a* and 63*b* are moved a long the bent parts 61*b* and 62*b* to be raised on the horizontal parts 61*a* and 62*a*, which in turn pushes the upper image forming section 9 upwards. As a result, the upper image forming section 9 is moved away from the intermediate transfer belt 11. Thereafter, the upper image forming section 9 is pulled in the P-direction along the guide rails 61 and 62 in the state completely separated from the intermediate transfer belt 11.

On the other hand, when mounting the upper image forming section 9 into the apparatus main body, the upper image forming section 9 is inserted in the Q-direction along the guide rails 61 and 62. When the guide pins 63*a* and 63*b* of the upper image forming section 9 are moved along the horizontal parts 61*a* and 62*a* and reach the bent parts 61*b* and 62*b*, the guide pins 63*a* and 63*b* are moved downwards along the shape of the bent parts 61*b* and 62*b*. As a result, when mounting the upper image forming section 9 into the apparatus main body, the entire upper image forming section 9 is lowered, and the photoreceptor drums 21*a* to 23*a* are brought into contact with the intermediate transfer belt 11.

As described, in the present embodiment, the guide pins 63*a* and 63*b* provided in the upper image forming section 9 are supported and guided by the guide rails 61 and 62. With this structure, the upper image forming section 9 is automatically brought into contact with and is separated from the intermediate transfer belt 11 interlocking with the sliding movements of the upper image forming section 9 in the P–Q directions. In the foregoing arrangement of the present embodiment having the interlocking structure, the lever 38 for manually separating the upper image forming section 9 from the intermediate transfer belt 11 can be omitted as in the case of the third embodiment, and thus the present embodiment offers a simplified structure as compared to that of the second embodiment.

The foregoing sliding mechanism in the P–Q direction of the upper image forming section 9 of the present embodiment is applicable to the sliding mechanism in the R–S direction of the upper image forming section 9 in the aforementioned third embodiment.

In any of the foregoing preferred embodiments, explanations have been given through the structure wherein the upper image forming section is provided with image forming stations (image forming stations 21 to 23) for respectively forming images in three different colors, and the lower image forming section 10 is provided with only the image forming station (image forming station 24) for forming monochrome images. However, the present invention is not limited to the above arrangement, and, for example, the sliding mechanism of the present invention is applicable to the structure wherein the upper image forming section 9 is provided with the image forming stations for forming images in C and M colors respectively, and the lower image forming sections 10 is provided with the image forming stations for forming images in Y and Bk colors respectively. This arrangement also offers the effects of the present invention of preventing a reduction in strength of the apparatus main body. Namely, the only requirement for the structure of the present invention is that the respective image forming stations of the image forming apparatus are separated in such a manner than the upper image forming section 9 is provided with at least one image forming station, and the lower image forming section 10 is provided with at least one image forming station.

It is preferable that the above explained sliding mechanism in the first through fourth embodiments is applied to a color image forming apparatus wherein toner image forming stations (image forming stations 21 to 23) for forming respective color toner images are provided above the intermediate transfer medium (intermediate transfer belt 11), and the toner image forming station for forming monochrome toner images (image forming station 24) is provided below the intermediate transfer medium. However, the sliding mechanism of the present invention can be applicable to other arrangements of the image forming apparatus as well. For example, the sliding mechanism of the present invention is applicable to i) an image forming apparatus wherein the toner image forming stations for forming respective color toner images are provided below the intermediate transfer medium, and the toner image forming station for forming monochrome toner images is provided above the intermediate transfer medium; ii) a tandem-type image forming apparatus wherein respective toner image forming stations are aligned in one direction; iii) an image forming apparatus (see, for example, Japanese Unexamined Patent Publication No. 341617/1993) in which the intermediate transfer system and the tandem system are combined.

Namely, the sliding mechanism of the present invention is applicable to any image forming apparatuses provided with a plurality of image forming stations for respectively forming images in different colors.

In view of the foregoing, the image forming apparatus of the present invention can be defined as an image forming apparatus provided with a plurality of image forming stations for respectively forming images in different colors, wherein at least one image forming station and rest of the plurality of image forming stations are slidable in mutually different directions respectively through openings formed on an apparatus main body in respective sliding directions.

The image forming apparatus of the present invention can be achieved, for example, by any of the arrangements of the following first through fifth image forming apparatuses.

The first image forming apparatus of the present invention provided with a plurality of image forming stations for respectively forming images in different colors includes a sliding mechanism for sliding the plurality of image forming stations in such a manner that at least one of the plurality of image forming stations and rest of the plurality of image forming stations are slidable in mutually different directions respectively through openings formed on an apparatus main body in respective sliding directions.

According to the above arrangement, compared with the case of sliding all the image forming stations in the same direction, an area of the opening through which the image forming stations are pulled out of the apparatus can be made smaller. As a result, a reduction in strength of the image forming apparatus as well as a displacement of images can be suppressed, and various maintenance operations of, for example, a photoreceptor drum or a developing section (such as a refill for toner consumed, etc.) can be performed with ease.

The second image forming apparatus, wherein an image formed by the first image forming section and an image formed by the second image forming section, which is in color from the image formed by the first image forming section, are transferred onto a recording medium via an intermediate transfer medium disposed between the first image forming section and the second image forming section, includes a sliding mechanism for sliding the first image forming section and the second image forming section in mutually different directions through respective openings formed on an apparatus main body in respective sliding directions.

According to the above arrangement, compared with the case of sliding the first image forming section and the second image forming section in the same direction, an area of the opening for pulling therethrough the first or second image forming section can be made smaller. As a result, a reduction in strength of the image forming apparatus as well as a displacement of images can be suppressed, and various maintenance operations of, for example, a photoreceptor drum or a developing section (such as a refill for toner consumed, etc.) can be performed with ease.

The third image forming apparatus of the present invention which includes i) toner image forming stations including developing units and image holding member units for forming respective color toner images for color images and black toner images for monochrome images, ii) an intermediate transfer medium for transferring the color toner images and the black toner images respectively formed by the toner image forming stations, and iii) a transfer medium for transferring the toner images formed on the intermediate transfer medium to a recording medium, is arranged such that:

the toner image forming stations for forming respective color toner images are provided on one side of the intermediate transfer medium, and the toner image forming station for forming monochrome toner images is provided on the other side of the intermediate transfer medium, and the developing units and the image holding member units for forming the color toner images are mounted so as to be detachable in an axial direction of image holding members of the image holding member units, while the developing unit and the image holding member unit for forming black toner images are mounted so as to be detachable in a direction orthogonal to the axial direction of the image holding members.

The fourth image forming apparatus of the present invention which includes i) toner image forming stations including developing units and image holding member units for forming respective color toner images for color images and black toner images for monochrome images, ii) an intermediate transfer medium for transferring the color toner images and the black toner images respectively formed by the toner image forming stations, and iii) a transfer medium for transferring the toner images formed on the intermediate transfer medium to a recording medium, is arranged such that:

the toner image forming stations for forming respective color toner images are provided on one side of the intermediate transfer medium, and the toner image forming station for forming monochrome images is provided on the other side of the intermediate transfer medium, and developing units and the image holding member units for forming color toner images are mounted so as to be detachable in a direction orthogonal to an axial direction of image holding members of the image holding member units, while the developing unit and the image holding member unit for forming black toner images are mounted so as to be detachable in the axial direction of the image holding members.

According to the foregoing arrangements of the third and fourth image forming apparatuses, compared with the case of sliding all the image forming apparatuses in the same direction, an area of the opening formed on the front face of the main body apparatus, through which the image forming stations are pulled out of the apparatus, can be made smaller. As a result, a sufficient strength of the main body of the image forming apparatus can be maintained, and a displacement of images can be suppressed. Moreover, various maintenance operations of a photoreceptor drums or a developing section (such as a refill for toner consumed, etc.) can be performed with ease.

The fifth image forming apparatus of the present invention having the structure of the third or forth image forming apparatus is arranged such that each image holding member unit is pulled out of the apparatus after being separated from the intermediate transfer medium.

According to the forgoing fifth image forming apparatus, a friction between the image holding member unit and the intermediate transfer medium can be prevented.

The guide means explained in the aforementioned third and fourth embodiments can be realized, for example, by the following arrangement.

The guide means of the present invention for guiding the sliding movements of the first image forming section or the second image forming section may be arranged such that the first image forming section or the second image forming section slides after being separated from the intermediate transfer medium.

The above guide means is further arranged such that the first image forming section or the second image forming section is brought into contact with the intermediate transfer medium again upon completing the sliding movements of the first image forming section or the second image forming section.

Here, it is needless to mention that the respective positions and the sizes of the guide rails, the guide plates, and the guide pins can be adjusted to be suited for respective applications.

As described, the image forming apparatus of the present invention is arranged such that at least one of the plurality of image forming stations and the rest of the image forming stations are slidable in mutually different directions through respective openings formed on the apparatus main body in respective sliding directions.

According to the foregoing arrangement, by dividing the sliding direction of the image forming stations into two, for example, the number of image forming stations which are slidable in the axial direction of the image holding members provided in the image forming stations can be simply reduced. As a result, a size of the opening formed in the axial direction can be made smaller, and thus a reduction in strength of the apparatus main body can be suppressed. Therefore, even in the case where the apparatus is used for a long time with an apparatus main body tilted due to installation conditions, etc., a distortion in the apparatus main body does not occur, and a displacement of each image forming station inside the apparatus can be prevented. As a result, a displacement of images in respective colors formed by the image forming stations can be suppressed, and thus a reduction in image quality can be avoided. Moreover, since each of the image forming stations is slidably mounted, maintenance operations of respective image forming stations can be surely performed.

As described, the image forming apparatus of the present invention is arranged such that the first image forming section and the second image forming section are provided so as to be slidable in mutually different directions through the respective openings formed in the apparatus main body.

According to the foregoing arrangement, for example, compared with the case of sliding both the first image forming section and the second image forming section in the axial direction of the image holding members of the respective image forming stations, a size of the opening formed in the axial direction can be reduced significantly, and thus a reduction in strength of the apparatus main body can be suppressed. Therefore, even in the case where the apparatus is used for a long time with an apparatus main body tilted due to installation conditions, the resulting distortion of the apparatus does not occur, and displacements in respective positions of the first and second image forming sections can be avoided. As a result, a displacement of images formed by respective image forming stations can be suppressed, and thus degradation of image quality can be avoided. Moreover, since each of the image forming stations is slidably mounted, maintenance operations of respective image forming stations can be surely performed.

As described, the image forming apparatus of the present invention is arranged such that the first image forming section and the second image forming section are provided with image holding members for different colors for holding thereon electrostatic latent images according to respective image data, whose axes are aligned in the same direction, and at least one of the first image forming section and the second image forming section is mounted so as to be slidable in the axial direction of the image holding members, and the other of the first image forming section and the second image forming section is mounted so as to be slidable in a direction orthogonal to the axial direction of the image holding members.

According to the foregoing arrangement, compared with the case of sliding both the first image forming section and the second image forming section in the axial direction of the image holding members, the number of the image forming stations which slide in the axial direction can be reduced, and an area of the face vertical to the axis of the image forming station can be reduced. As a result, the size of the opening in the axial direction corresponding to the vertical face can be made significantly smaller, and a reduction in strength of the apparatus main body can be surely suppressed.

In the above image forming apparatus, one of the first image forming section and the second image forming section is provided for forming black-and-white images, and the other of the first image forming section and the second image forming section is provided for forming color images.

According to the foregoing arrangement, the image forming stations for forming color images and the image forming stations for forming black-and-white images can be separately provided with the intermediate transfer medium in between. As a result, for example, in a circulation of the intermediate transfer medium, only a black-and-white image can be transferred onto a recording medium via the intermediate transfer medium, which permits a high speed copying of the black-and-white image.

The image forming apparatus of the present invention may be arranged such that the first image forming section is provided so as to be slidable in the axial direction of the image holding members, while the second image forming section is provided so as to be slidable in the direction orthogonal to the axial direction.

According to the foregoing arrangement, the opening in the axial direction of the image holding member can be formed in consideration of only the size of the first image forming section for forming color images. As a result, compared with the case wherein both the first image forming section and the second image forming section slide in the axial direction, the size of the opening formed in the axial direction can be made significantly smaller, and a reduction in strength of the apparatus main body can be surely suppressed.

Another image forming apparatus of the present invention may be arranged such that the first image forming section is provided so as to be slidable in the direction orthogonal to the axial direction of the image holding members, while the second image forming section is provided so as to be slidable in the axial direction.

According to the foregoing arrangement, the size of the opening in the axial direction of the image holding member can be set in consideration of only the size of the second image forming section for forming black-and-white images. As a result, compared with the case wherein both the first image forming section and the second image forming section slide in the axial direction, the size of the opening in the axial direction can be made significantly smaller, and a reduction in strength of the apparatus main body can be surely suppressed.

The image forming apparatus of the present invention may further include the guide means for guiding sliding movements of the first image forming section or the second image forming section in such a manner that the first image forming section or the second image forming section is separated from and is brought into contact with the intermediate transfer medium, interlocking with its sliding movements.

According to the foregoing structure, when sliding the first or second image forming section, such problem that the first or second image forming section and the intermediate transfer medium are always in contact with each other can be surely prevented. As a result, a friction between the first or second image forming section and the intermediate transfer medium can be avoided, and thus the resulting damage on the first or second image forming section or the intermediate transfer medium can be surely prevented.

Moreover, since the first or second image forming section is brought into contact with and is separated from the intermediate transfer medium, interlocking with its sliding movements, a mechanism for preventing the above problem of friction (for example, separation and contact between the first or second image forming section and the intermediate transfer medium is switched by manually operating a switch lever) can be omitted.

According to the above arrangement, the above problem can be avoided without increasing the number of components of the apparatus. Moreover, i) the sliding movements of the first and second image forming sections and ii) the switching between the separated state and the contact state of the first or second image forming section and the intermediate transfer material can be achieved by a simple means of the guide means.

As described, the image forming apparatus of the present invention may be arranged such that the first image forming section and the second image forming section are provided with image holding member units for forming electrostatic latent images according to the image data and the developing units for developing the electrostatic latent images for respective colors.

Therefore, maintenance operations of the image holding member units and the developing units for respective colors can be performed by sliding the first or second image forming section.

As described, the image forming apparatus of the present invention is arranged such that each developing unit includes a developing section for developing an electrostatic latent image formed on the image holding member with toner in corresponding color, and a developer vessel for supplying the toner to the developing section.

According to the foregoing structure, maintenance operations of the developing section and the developer vessel which constitute each developing unit can be performed at the same time by the sliding mechanism of the first or second image forming section.

As described, the image forming apparatus of the present invention is arranged such that each image holding member unit includes an image holding member for holding an electrostatic latent image, a charger for charging the surface of the image holding member, and a cleaning unit for clearing the surface of the image holding member.

According to the foregoing structure, various maintenance operations of the image holding member, the charger, and the cleaning unit can be performed at the same time by the sliding mechanism of the first or second image forming sections.

An image forming apparatus of the present invention provided with a plurality of image forming stations respectively for forming images in different colors is characterized in that at least one image forming station and rest of the plurality of image forming stations are slidable in mutually different directions respectively through openings formed on an apparatus main body in respective sliding directions.

According to the above arrangement, the image forming stations corresponding to respective colors do not slide all in the same direction, but in two different directions. Here, the number of image forming stations which slide in each direction is not limited, and one or a plurality of image forming stations may slide in each direction. In any case, the image forming stations slide in mutually different directions through respective openings formed on the apparatus main body in respective sliding directions.

For example, in the case where one of the openings is formed in the axial direction of image holding members provided in the image forming stations, respective image forming stations being aligned in parallel in a direction orthogonal to the axial direction. In the conventional arrangement, all the image forming stations slide in the axial direction, and thus the opening formed in the axial direction is required to have a large size, and thus the reduction in strength of the apparatus main body having the opening cannot be avoided.

However, according to the arrangement of the present invention, by dividing the sliding direction of the image forming stations into two, for example, the number of image forming stations which slide in the axial direction of the image holding members provided in the image forming stations can be simply reduced. As a result, a size of the opening formed in the axial direction can be made smaller, and thus a reduction in strength of the apparatus main body can be suppressed. Therefore, even in the case where the apparatus is used for a long time with an apparatus main body tilted due to installation condition, the resulting displacement of each image forming station inside the apparatus can be prevented without causing a distortion in the apparatus main body. As a result, a displacement of images formed by the image forming stations for respective colors can be suppressed, and thus a degradation of image quality can be avoided. Moreover, since each of the image forming stations is slidably mounted, maintenance operations of respective image forming stations can be surely performed.

Another image forming apparatus of the present invention is characterized in that an image formed by the first image forming section and an image formed by the second image forming section in different color from the image formed by the first image forming section are transferred onto a recording medium via the intermediate transfer medium disposed between the first image forming section and the second image forming section is characterized in that the first image forming section and the second image forming section slide in mutually different directions through respective openings formed on an apparatus main body in respective sliding directions.

In the above structure, first image forming section may be a group of image forming stations for respectively forming color images in different colors. On the other hand, the second image forming section may be an image forming station for forming images in different color from that of the above color images, such as a black-and-white image.

According to the above structure of having the intermediate transfer medium between the first image forming section and the second image forming section, for example, a black-and-white image formed by the second image forming section can be transferred onto a recording medium in a circulation of the intermediate transfer medium from the second image forming section to the first image forming section. Namely, the black-and-white image can be transferred onto the recording medium without passing through a transfer region for color image on the intermediate transfer medium. As a result, a high speed copying of a black-and-white image can be performed.

According to the above structure, the first image forming section and the second image forming section do not slide in the same direction, but in mutually different directions through respective openings formed on the apparatus main body in respective sliding directions. In this case, the size of the opening formed in each sliding direction can be set according to the size of the first image forming section or the second image forming section. Therefore, compared with the case wherein both the first image forming section and the second image forming section slide in the axial direction of the image holding members provided in respective image forming stations, the size of each opening can be made significantly smaller.

Therefore, according to the above arrangement, by making each opening smaller, the reduction in strength of the apparatus main body can be suppressed. Therefore, even in the case where the apparatus is used for a long time with the apparatus main body tilted due to installation condition, the resulting displacement of each image forming station inside the apparatus can be prevented without causing a distortion in the apparatus main body. As a result, a displacement of an image formed by an image forming station in each color can be suppressed, and thus degradation of image quality with life can be avoided. Moreover, since each of the image forming stations is slidably mounted, maintenance operations of each image forming station can be surely performed.

A still another image forming apparatus of the present embodiment is characterized in that the first image forming section and the second image forming section include respective image holding members for different colors for holding electrostatic latent images according to respective image data, which are rotatable about axes aligned in the same direction, and at least one of the first image forming section and the second image forming section is mounted so as to be slidable in the axial direction of the image forming members, and the other of the first image forming section and the second image forming section is mounted so as to be slidable in a direction orthogonal to the axial direction of the image holding members.

According to the above structure, the first image forming section and the second image forming section slide in mutually orthogonal directions, and one of the sliding directions is the axial direction of the image holding members. Moreover, the first image forming section and the second image forming section are arranged such that the respective axial directions of the image holding members are aligned. Therefore, compared with the case of sliding both the first image forming section and the second image forming section in the axial direction of the image holding members, the number of image forming stations which slide in the axial direction can be reduced, and an area of the face of the image forming station vertical to the axes can be made smaller. As a result, the size of the opening formed in the axial direction corresponding to the vertical face can be surely reduced, and whereby a reduction in strength of the apparatus main body can be surely reduced.

The foregoing image forming apparatus of the present invention may be characterized in that one of the first image forming section and the second image forming section is for forming black-and-white images, and the other of the first image forming section and the second image forming section is for forming color images.

According to the above arrangement, the image forming stations for forming color images and the image forming station for forming black-and-white images can be separately provided with the intermediate transfer medium in between. As a result, for example, in a circulation of the intermediate transfer medium, only a black-and-white image can be transferred onto a recording medium via the intermediate transfer medium, which permits a high speed copying of the black-and-white image.

The foregoing image forming apparatus may be characterized in that the first image forming section slides in the axial direction of the image holding member, and the second image forming section slides in the direction orthogonal to the axial direction of the image holding member.

According to the above arrangement, the opening in the axial direction of the image holding member can be set in consideration of only the size of the first image forming section for forming color images. Therefore, compared with the arrangement of sliding both the first image forming section and the second image forming section in the axial direction, the size of the opening in the axial direction can be made significantly smaller, thereby surely suppressing a reduction in strength of the apparatus main body.

The forgoing image forming apparatus of the present invention may be characterized in that the first image forming section slides in the direction orthogonal to the axial direction of the image holding members, and the second image forming section slides in the axial direction of the image holding member.

According to the above arrangement, the opening in the axial direction of the image holding member can be set in consideration of only the size of the second image forming section for forming black-and-white images. Therefore, compared with the arrangement of sliding both the first image forming section and the second image forming section in the axial direction, the size of the opening in the axial direction can be made significantly smaller, thereby surely suppressing a reduction in strength of the apparatus main body.

The forgoing image forming apparatus of the present invention may be characterized by including guide means for guiding sliding movements of the first image forming section or the second image forming section in such a manner that the first image forming section or the second image forming section is separated from or is in contact with the intermediate transfer medium interlocking with the sliding movements of the first image forming section or the second image forming section, respectively.

According to the above structure, for example, when sliding the first image forming section to be pulled out of the apparatus main body, the sliding movements of the first image forming apparatus are guided by the guide means so as to slide after being separated from the intermediate transfer medium. On the other hand, when sliding the first image forming apparatus to be mounted in its installation position of the apparatus main body, the sliding movements of the first image forming section are guided by the guide means so as to come in contact with the intermediate transfer medium upon completing its sliding movements. The above structure of guiding the sliding movements of the first image forming section can be applied to the second image forming section.

According to the foregoing arrangement, the first or second image forming section is not always in contact with the intermediate transfer medium in its sliding movements. As a result, a friction between the first or second image forming section and the intermediate transfer medium can be surely prevented, and thus a damage on the first image forming section, the second image forming section, and the intermediate transfer medium can be surely prevented.

Moreover, as the first image forming section or the second image forming section is separated from and is brought in contact with the intermediate transfer medium interlocking with its sliding movements by the guide means, a separately provided mechanism for preventing such problem (a lever for manually switching contact and non-contact between the first or second image forming section and the intermediate transfer medium) can be omitted.

Therefore, according to the forgoing arrangement, the structure for preventing a friction between the first or second image forming section and the intermediate transfer medium can be achieved without increasing the number of the components. Moreover, sliding movements of the first and second image forming sections, and the switching between contact/non-contact between the first image forming section and the intermediate transfer medium can be performed simultaneously by the simple structure of adding the guide means.

The foregoing image forming apparatus of the present invention may be characterized in that: the first image forming section and the second image forming section include for respective different colors pairs of i) image holding member units for forming electrostatic latent images according to image data and ii) developing units for developing the electrostatic latent images.

According to the above arrangement, maintenance operations of the image holding member units and the developing units for respective colors can be performed simultaneously by the sliding movements of the first and second image forming sections.

The above image forming apparatus may be further arranged such that each of the image holding member units includes a developing section for developing an electrostatic latent image formed on an image holding member with toner in corresponding color, and a developer vessel for supplying the toner to the developing section.

According to the above arrangement, various maintenance operations of the developing section and the developing vessel which constitute each developing unit can be performed simultaneously by sliding the first and second image forming sections.

The above image forming apparatus may be further arranged such that each of the image holding member units includes an image holding member for holding the electrostatic latent image, a charger for charging a surface of the image holding member, and a cleaning unit for cleaning the surface of the image holding member.

According to the foregoing arrangement, various maintenance operations of the image holding member, the charger and the cleaning unit which constitute each image holding member unit can be performed simultaneously by sliding the first and second image forming sections.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. An image forming apparatus, comprising:

first image forming sections for forming an image;

second image forming sections for forming an image in different color from the image formed by said first image forming sections; and an intermediate transfer medium disposed between said first image forming sections and said second image forming sections, wherein the image formed by said first image forming sections and the image formed by said second image forming sections are transferred onto a recording medium by said intermediate transfer medium, and said first image forming sections and said second image forming sections are slidable in mutually different directions respectively through openings formed on an apparatus main body in respective sliding directions, wherein:

said first image forming sections and said second image forming sections include, for respective different colors, image holding members for holding electrostatic latent images according to the image data, said image holding members are rotatable about respective axes aligned in a same direction, and one of said first image forming sections and said second image forming sections are slidable in an axial direction of the image holding members and the others of said first image forming sections and said second image forming sections are slidable in a direction orthogonal to the axial direction.

2. The image forming apparatus as set forth in claim 1, wherein:

a diameter of respective image holding members of said first image forming sections is smaller than a diameter of an image holding member of said second image forming sections.

3. An image forming apparatus, comprising:

first image forming sections for forming an image;

second image forming sections for forming an image in different color from the image formed by said first image forming sections; and an intermediate transfer medium disposed between said first image forming sections and said second image forming sections, wherein the image formed by said first image forming sections and the image formed by said second image forming sections are transferred onto a recording medium by said intermediate transfer medium, and said first image forming sections and said second image forming sections are slidable in mutually different directions respectively through openings formed on an apparatus main body in respective sliding directions, wherein:

one of said first image forming sections and said second image forming sections are provided for forming black-and-white images, and the other of said first image forming sections and said second image forming sections are provided for forming color images, wherein:

said first image forming sections are slidable in an axial direction of the image holding members, and said second image forming sections are slidable in a direction orthogonal to the axial direction.

4. An image forming apparatus, comprising:

first image forming sections for forming an image;

second image forming sections for forming an image in different color from the image formed by said first image forming sections; and an intermediate transfer medium disposed between said first image forming sections and said second image forming sections, wherein the image formed by said first image forming sections and the image formed by said second image forming sections are transferred onto a recording medium by said intermediate transfer medium, and said first image forming sections and said second image forming sections are slidable in mutually different directions respectively through openings formed on an apparatus main body in respective sliding directions, wherein:

one of said first image forming sections and said second image forming sections are provided for forming black-and-white images, and the other of said first image forming sections and said second image forming sections are provided for forming color images, wherein:

said first image forming sections are slidable in a direction orthogonal to an axial direction of the image holding members, and said second image forming sections are slidable in the axial direction.

5. An image forming apparatus, comprising:

a first image forming section for forming an image;

a second image forming section for forming an image in different color from the image formed by said first image forming section, and an intermediate transfer medium disposed between said first image forming section and said second image forming section, wherein the image formed by said first image forming section and the image formed by said second image forming section are transferred onto a recording medium by said intermediate transfer medium, and said first image forming section and said second image forming section are slidable in mutually different directions respectively through openings formed on an apparatus main body in respective sliding directions, and:

guide means for guiding sliding movements of said first image forming section or said second image forming section in such a manner that said first image forming section or said second image forming section is separated from or is in contact with said intermediate transfer medium interlocking with the sliding movements of said first image forming section or said second image forming section, respectively.

6. The image forming apparatus as set forth in claim 5, wherein:

said guide means includes guide rails and guide pins, is a sliding mechanism of said first image forming section or said second image forming section.

7. An image forming apparatus, comprising:

a first image forming section for forming an image;

a second image forming section for forming an image in different color from the image formed by said first image forming section, and an intermediate transfer medium disposed between said first image forming section and said second image forming section, wherein the image formed by said first image forming section and the image formed by said second image forming section are transferred onto a recording medium by said intermediate transfer medium, and said first image forming section and said second image forming section are slidable in mutually different directions respectively through openings formed on an apparatus main body in respective sliding directions, wherein:

said first image forming section and said second image forming section include for respective different colors pairs of image holding member units for forming electrostatic latent images according to image data and developing units for developing the electrostatic latent images.

8. The image forming apparatus as set forth in claim 7, wherein:

each of said image holding member units includes a developing section for developing an electrostatic latent image formed on an image holding member with toner in corresponding color, and a developer vessel for supplying the toner to said developing section.

9. The image forming apparatus as set forth in claim 7, wherein:

each of said image holding member units includes an image holding member for holding the electrostatic latent image, a charger for charging a surface of the image holding member, and a cleaning unit for cleaning the surface of the image holding member.

10. An image forming apparatus, comprising:

first image forming sections for forming an image;

second image forming sections for forming an image in different color from the image formed by said first image forming section;

an intermediate transfer medium disposed between said first image forming sections and said second image forming sections, wherein the image formed by said first image forming sections and the image formed by said second image forming sections are transferred onto a recording medium by said intermediate transfer medium, said first image forming sections and said second image forming sections are slidable in mutually different directions respectively through openings formed on an apparatus main body in respective sliding directions, one of said first image forming sections and said second forming sections are slidable in an axial direction of the image holding members, and the other of said first image forming sections and said second image forming sections are slidable in a direction orthogonal to the axial direction.

* * * * *